US010093124B2

(12) United States Patent
Holmes

(10) Patent No.: US 10,093,124 B2
(45) Date of Patent: Oct. 9, 2018

(54) SECURITY DEVICES AND METHODS OF MANUFACTURE

(71) Applicant: DE LA RUE INTERNATIONAL LIMITED, Basingstoke, Hampshire (GB)

(72) Inventor: Brian Holmes, Fleet (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 299 days.

(21) Appl. No.: 14/908,029

(22) PCT Filed: Jul. 25, 2014

(86) PCT No.: PCT/GB2014/052285
§ 371 (c)(1),
(2) Date: Jan. 27, 2016

(87) PCT Pub. No.: WO2015/011493
PCT Pub. Date: Jan. 29, 2015

(65) Prior Publication Data

US 2016/0167421 A1 Jun. 16, 2016

(30) Foreign Application Priority Data

Jul. 26, 2013 (GB) ..... 1313362.4

(51) Int. Cl.
*B42D 25/00* (2014.01)
*B42D 25/324* (2014.01)
(Continued)

(52) U.S. Cl.
CPC ..... *B42D 25/324* (2014.10); *B42D 25/00* (2014.10); *B42D 25/23* (2014.10); *B42D 25/328* (2014.10); *B42D 25/355* (2014.10); *B42D 25/425* (2014.10)

(58) Field of Classification Search
None
See application file for complete search history.

(56) References Cited

U.S. PATENT DOCUMENTS 4,652,015 A 3/1987 Crane
4,892,336 A 1/1990 Kaule et al.
(Continued)

FOREIGN PATENT DOCUMENTS

DE 102008029638 A1 12/2009
EP 0 059 056 A1 9/1982
(Continued)

OTHER PUBLICATIONS

Nov. 3, 2014 Search Report issued in International Patent Application No. PCT/GB2014/052285.
(Continued)

*Primary Examiner* — Kyle R Grabowski
(74) *Attorney, Agent, or Firm* — Oliff PLC

(57) ABSTRACT

A security device has: an array of focusing elements on a grid; and an array of image elements overlapping the focusing elements array and arranged based on a repeating unit cell defining image element positions. The unit cell periodicity is substantially the same as the grid's. Each position is assigned to carry an image element of a respective corresponding image. Dependent on angle, the focusing elements array directs light from selected positions, as the device is tilted different ones of the respective images are displayed by the elements at the selected positions in combination, sequentially. Each unit cell center area, larger than each outer area, is assigned to carry element(s) of a corresponding center image, the outer areas assigned to carry element(s) of other respective images, such that the range of viewing angles over which the center image is displayed is greater than that over which each other image is.

29 Claims, 19 Drawing Sheets

(51) Int. Cl.

| | |
|---|---|
| ***B42D 25/425*** | (2014.01) |
| ***B42D 25/328*** | (2014.01) |
| ***B42D 25/355*** | (2014.01) |
| ***B42D 25/23*** | (2014.01) |

(56) References Cited

U.S. PATENT DOCUMENTS

| | | | | |
|---|---|---|---|---|
| 6,369,949 | B1 | 4/2002 | Conley | |
| 6,483,644 | B1 * | 11/2002 | Gottfried | G02B 27/2228 345/419 |
| 6,856,462 | B1 | 2/2005 | Scarbrough et al. | |
| 6,995,914 | B1 | 2/2006 | Conley et al. | |
| 2012/0127571 | A1 | 5/2012 | Kanzaki et al. | |

FOREIGN PATENT DOCUMENTS

| | | | |
|---|---|---|---|
| EP | 0723501 | A1 | 7/1996 |
| EP | 0724519 | A1 | 8/1996 |
| EP | 0 860 298 | A2 | 8/1998 |
| EP | 1141480 | A1 | 10/2001 |
| EP | 1 398 174 | A1 | 3/2004 |
| EP | 1695121 | A2 | 8/2006 |
| EP | 2460667 | A2 | 6/2012 |
| GB | 2490780 | A | 11/2012 |
| WO | 83/00659 | A1 | 3/1983 |
| WO | 94/27254 | A1 | 11/1994 |
| WO | 00/039391 | A1 | 7/2000 |
| WO | 03/054297 | A2 | 7/2003 |
| WO | 03/091952 | A2 | 11/2003 |
| WO | 03/095188 | A2 | 11/2003 |
| WO | 2005/052650 | A2 | 6/2005 |
| WO | 2005/106601 | A2 | 11/2005 |
| WO | 2005/115119 | A2 | 12/2005 |
| WO | 2008/000350 | A1 | 1/2008 |
| WO | 2011/051669 | A1 | 5/2011 |
| WO | 2011/051670 | A2 | 5/2011 |
| WO | WO-2011051669 | A1 * | 5/2011 ..... B42D 25/29 |
| WO | 2011/102800 | A1 | 8/2011 |
| WO | 2011/107782 | A1 | 9/2011 |
| WO | 2011/107783 | A1 | 9/2011 |
| WO | 2012/027779 | A1 | 3/2012 |
| WO | 2013/054119 | A1 | 4/2013 |

OTHER PUBLICATIONS

Jan. 26, 2016 International Preliminary Report on Patentability issued in International Patent Application No. PCT/GB2014/052285.

Jan. 28, 2014 Search Report issued in British Patent Application No. 1313362.4.

Dec. 3, 2014 Search Report issued in British Patent Application No. 1413233.6.

* cited by examiner

SECURITY DEVICES AND METHODS OF MANUFACTURE

This invention relates to security devices, for example for use on articles of value such as banknotes, cheques, passports, identity cards, certificates of authenticity, fiscal stamps and other documents of value or personal identity. Methods of manufacturing such security devices are also disclosed.

Articles of value, and particularly documents of value such as banknotes, cheques, passports, identification documents, certificates and licences, are frequently the target of counterfeiters and persons wishing to make fraudulent copies thereof and/or changes to any data contained therein. Typically such objects are provided with a number of visible security devices for checking the authenticity of the object. Examples include features based on one or more patterns such as microtext, fine line patterns, latent images, Venetian blind devices, lenticular devices, moiré interference devices and moiré magnification devices, each of which generates a secure visual effect. Other known security devices include holograms, watermarks, embossings, perforations and the use of colour-shifting or luminescent/fluorescent inks. Common to all such devices is that the visual effect exhibited by the device is extremely difficult, or impossible, to copy using available reproduction techniques such as photocopying. Security devices exhibiting non-visible effects such as magnetic materials may also be employed.

One class of security devices are those which produce an optically variable effect, meaning that the appearance of the device is different at different angles of view. Such devices are particularly effective since direct copies (e.g. photocopies) will not produce the optically variable effect and hence can be readily distinguished from genuine devices. Optically variable effects can be generated based on various different mechanisms, including holograms and other diffractive devices, and also devices which make use of focusing elements such as lenses, including moiré magnifier devices, integral imaging devices and so-called lenticular devices.

Moiré magnifier devices (examples of which are described in EP-A-1695121, WO-A-94/27254, WO-A-2011/107782 and WO2011/107783) make use of an array of micro-focusing elements (such as lenses or mirrors) and a corresponding array of microimage elements, wherein the pitches of the micro-focusing elements and the array of microimage elements and/or their relative locations are mismatched with the array of micro-focusing elements such that a magnified version of the microimage elements is generated due to the moiré effect. Each microimage element is a complete, miniature version of the image which is ultimately observed, and the array of focusing elements acts to select and magnify a small portion of each underlying microimage element, which portions are combined by the human eye such that the whole, magnified image is visualised. This mechanism is sometimes referred to as "synthetic magnification".

Integral imaging devices are similar to moiré magnifier devices in that an array of microimage elements is provided under a corresponding array of lenses, each microimage element being a miniature version of the image to be displayed. However here there is no mismatch between the lenses and the microimages. Instead a visual effect is created by arranging for each microimage to be a view of the same object but from a different viewpoint. When the device is tilted, different ones of the images are magnified by the lenses such that the impression of a three-dimensional image is given.

Lenticular devices on the other hand do not rely upon magnification, synthetic or otherwise. An array of focusing elements, typically cylindrical lenses, overlies a corresponding array of image elements, or "slices", each of which depicts only a portion of an image which is to be displayed. Image slices from two or more different images are interleaved and, when viewed through the focusing elements, at each viewing angle, only selected image slices will be directed towards the viewer. In this way, different composite images can be viewed at different angles. However it should be appreciated that no magnification typically takes place and the resulting image which is observed will be of substantially the same size as that to which the underlying image slices are formed. Some examples of lenticular devices are described in U.S. Pat. No. 4,892,336, WO-A-2011/051669, WO-A-2011051670, WO-A-2012/027779 and U.S. Pat. No. 6,856,462. Lenticular devices have the advantage that different images can be displayed at different viewing angles, giving rise to the possibility of animation and other striking visual effects which are not possible using the moiré magnifier or integral imaging techniques.

The majority of known lenticular devices are one-dimensional lenticular devices (i.e. devices which display an optically variable effect when tilted about one axis only). However, two-dimensional lenticular devices are also known and examples are disclosed in U.S. Pat. No. 6,483,644 which sets out to achieve a result visually comparable to that of an integral imaging device and does so by providing a two-dimensional array of image elements comprising selected pixels from at least two images interwoven with one another. The array is viewed through a viewing screen such as an array of fly-eye (semi-spherical) lenses, such that different ones of the images are displayed as the device is tiled. This amounts to a two-dimensional lenticular device.

Known lenticular devices (both one-dimensional and two-dimensional) such as those mentioned above suffer from the problem that, at certain viewing angles, the region of the image element array directed to the viewer will not correspond to a single image element but may include an intersection between two or possibly more image elements relating to different images. This can be made worse where the device is formed on a flexible substrate (as will typically be the case in the field of security documents) since the device may not be entirely flat when viewed, causing additional distortion to the viewing geometry. This results in visual confusion since a mixture of two or more images are displayed simultaneously and typically overlapping one another spatially. This reduces the visual impact of the security device.

In accordance with the present invention a security device is provided, comprising:

- an array of focusing elements, each focusing element being adapted to focus light in at least a first direction, the focusing elements being arranged on a regular grid in at least one dimension; and
- an array of image elements overlapping the array of focussing elements, the image elements being arranged based on a repeating unit cell defining image element positions, the periodicity of the unit cells being substantially the same as that of the grid on which the array of focusing elements is arranged, the unit cell defining a set of image element positions therewithin, each image element position within the unit cell being assigned to carry an image element of a respective corresponding image;

whereby, depending on the viewing angle, the array of focusing elements directs light from selected image element positions to the viewer, such that as the device is tilted different ones of the respective images are displayed by the image elements at the selected image element positions in combination, sequentially;

wherein a centre area of each unit cell, comprising one or more image element positions, is assigned to carry image element(s) of a corresponding centre image, the centre area being larger than each outer area of the unit cell, the outer areas being located outside the centre area and assigned to carry image element(s) of other respective images, such that the range of viewing angles over which the centre image is displayed to a viewer is greater than the range of viewing angles over which each other image is displayed.

The present invention also provides a method of manufacturing a security device, the method comprising providing the said array of focusing elements, and forming the said array of image elements.

By arranging the image elements based on a unit cell in which an enlarged area (the centre area) is assigned to display of a centre image, visual confusion is reduced or eliminated and the overall visual impression of the device enhanced. This is because a larger proportion of the unit cell is provided for display of the centre image as compared with that provided for displaying each other image. As such the focusing elements will direct light from within the centre area to the viewer at more viewing positions than will be the case for light from any one outer area. No intersections between image element positions assigned to different images will be encountered until the device is tilted to such an extent that the portion of the unit cell surface which is directed to the viewer by the focusing element falls reaches the perimeter of the centre area. The result is a device which presents a clear, strong, static image over small tilt angles and yet exhibits an optically variable effect upon investigation by tilting further.

It will be appreciated that it is the range of viewing angles over which each respective image is continuously displayed that is relevant, i.e. the range of viewing angles over which the centre image is continuously displayed to a viewer is greater than the range of viewing angles over which each other image is continuously displayed. For instance, in one example the centre image may be displayed when viewed along the normal and at angles up to +/−5 degrees either side when tiled about one axis (i.e. a total of 10 degrees), whilst two identical outer images might be visible between −15 degrees and −10 degrees, and between +10 degrees and +15 degrees. Whilst the same outer image would therefore be visible at −15 and +15 degrees, it is not continuously displayed throughout the intervening viewing angles, and hence the range of viewing angles over which the centre image is displayed to a viewer (10 degrees) is greater than the range of viewing angles over which the outer image is displayed (5 degrees at a time).

It should be appreciated that the security device is an example of a lenticular device, and as such each image element is a portion (e.g. an individual pixel, or a group of pixels) of the corresponding image, not a miniature version of the corresponding image (as would be the case in a moiré magnifier or integral imaging type device). Each set of image elements (filling one unit cell) provides one portion of each image and corresponds to one focusing element which will select an image element from the set for display to the viewer depending on the viewing angle. The image elements all lie in substantially the same plane and the focussing elements are capable of directing light from any of the image elements, depending only on the viewing angle. The selected image elements across the array of focusing elements and corresponding unit cells combine to display one of the available images in full, the selected image being dependent on the viewing angle. The focusing elements preferably do not perform any magnification. It will also be understood that, depending on the particular images to be displayed by the device, not all of the image element positions in every cell of the image element array may ultimately carry an image element. Some image element positions may remain blank, if the corresponding image requires it.

The centre area could be defined within the unit cell in various different ways. In a first preferred embodiment, the centre area comprises a single centre image element position which is larger than each of the other image element positions defined by the unit cell. Thus, the centre image will be divided up into larger portions (image elements) for incorporation into the image element array than those of any of the other images to be displayed by the device. This implementation is advantageous since whilst the size of some or all of the image element positions outside the centre area may be reduced (as compared with previously known arrangements), their number need not be reduced so that the number of different images which can be displayed by the device is maintained. In this case, preferably, each outer area of the unit cell (i.e. the area assigned to each image other than the centre image) comprises a single image element position which is smaller than the centre image element position.

Any increase in size of the centre image element position relative to those outside the centre area will improve the visual impression of the device as described above, but advantageously, the centre image element position is at least 10% and preferably at least 25% larger than the average size of the other the image element positions defined by the unit cell. By "size" here, we refer to the distance from one side of the image element position to the other along at least the first direction, preferably also along the second orthogonal direction, although it is also preferred that the centre image element is greater than the other image elements in terms of area. If the image element positions outside the centre area are of a variety of sizes, the centre image element position should still have a greater dimension than the largest of those other image element positions. It has been found that proportions such as those indicated above provide a good balance between improved visual stability (promoted by increasing the size of the centre image element position) and retaining sufficient space in the unit cell for carrying other images as required for the desired optically variable lenticular effect.

More generally, in one-dimensional devices, where the image elements are elongate strips, the different sizes of the image element positions will be embodied by different widths of the image strips, which is the dimension along the first direction in that case. The lenticular effect and the above-described visual stabilisation will be observed when the device is tilted in the first direction. In two-dimensional devices, the image elements will preferably not be elongate and may for instance be squares or rectangles. In this case the enlarged centre image element will be embodied by an increased side-to-side dimension (relative to the other image element positions) in at least one direction (the first direction), but preferably also in an orthogonal second direction, so that the visual stabilisation is achieved in both tilt directions.

In some embodiments, the increased size of the centre image element position may be accommodated by reducing the size of only those image element positions immediately adjacent to it. Thus, the image element positions outside and immediately adjacent the centre image element position may preferably be smaller than surrounding image element positions located towards the periphery of the unit cell. This has the advantage that the remaining image element positions can retain their original size. However in this case the images assigned to the smallest image element positions will be displayed for a relatively short range of tilt angles. As such it may be preferred to resize all of the image element positions outside the centre area to accommodate the enlarged centre image element position, in which case all of the image elements except the centre image element in the unit cell can be of substantially the same size.

Instead of providing an enlarged image element position to form the centre area, in other preferred embodiments, the centre area comprises a sub-set of at least two of the image element positions defined by the unit cell, each image element position in the sub-set being assigned to carry a copy of the same image element of the centre image. By providing multiple image element positions at the centre of each cell (forming the "sub-set") assigned to carry copies of the same image element from a common image (the "centre" image), the centre area includes no intersections between different image elements. As such, whichever portion of the sub-set is directed to a viewer by the focussing array (in dependence on the viewing angle), the same (centre) image will be displayed, without interference. Only when the device is tilted such that image element positions outside the sub-set are selected by the focussing elements will the optically variable effect be viewed. This implementation may be preferred where there is a relatively large number of image element positions defined within each unit cell such that multiple positions can be assigned to the sub-set whilst a sufficient number of image element positions remain outside the sub-set for carrying portions of respective images which are different from the centre image. (It will be appreciated that the "sub-set" does not include all of the image element positions in the unit cell.)

This can be applied to one-dimensional or two-dimensional devices and in the case of two dimensional devices the sub-set could nonetheless be arranged to extend along only one direction if a different effect is sought when the device is tilted in the two different directions. However, preferably, the unit cell defines a two-dimensional set of image element positions, comprising image element positions arranged along both the first direction and a second orthogonal direction, and the sub-set comprises a two-dimensional array of image element positions e.g. the sub-set may be an array of m×n image element positions, where m and n are both integer numbers of at least 2. Thus the sub-set may comprise at least two adjacent image element positions arranged along the first direction and at least two adjacent image element positions arranged along the second direction. In this way, visual confusion is reduced for tilt angles in both orthogonal directions. In a particularly preferred implementation, the sub-set comprises substantially the same number of image element positions arranged along the first direction as are arranged along the second direction, e.g. the sub-set may be an array of m×m image element positions. This is desirable since visual confusion can be reduced by a substantially equal degree in both axes. Preferably, in this embodiment, all of the image element positions defined within the unit cell are of substantially the same size.

Outside the centre area, the image element positions could take a number of different arrangements. For instance, each image element position may be assigned to a different image, or groups of multiple image element positions could be assigned to each different image. Thus, preferably, each outer area of the unit cell comprises either a single image element position, or a group of fewer image element positions than form part of the sub-set. In the latter case, each image element position within one group would typically carry a copy of the same image element from the corresponding image.

However it is formed, the centre area is located to include the centre of the unit cell (e.g. the diagonal intersection of a square/rectangular unit cell, or the intersection of two lines joining opposite corners of a hexagonal unit cell) and this is in order to position the image element(s) of the centre image near the centre of each focussing element so that the centre image is displayed when the device is viewed on-axis and/or close to on-axis. Preferably, the sub-set is centred on the centre of the unit cell, i.e. the geometric centre of the sub-set coincides with that of the unit cell.

Whether the centre area comprises a single enlarged image element position or a sub-set of (plural) image element positions, it is preferred that the centre area is at least 10% larger, preferably at least 25% larger than the average size of the outer areas of the unit cell, for the same reasons as given above. As mentioned above, here the term "size" refers to the distance from one side of the centre area to the other along at least the first direction. If the outer areas are of a variety of sizes, the centre area should still be larger in this sense than the largest of the outer areas. In two-dimensional devices, the centre area preferably has a larger side-to-side dimension than any of the outer areas in both the first and second orthogonal directions.

Preferably, the image corresponding to the centre area of the unit cell and the images corresponding to each outer area will all be different images from one another. Alternatively, some images may be the same but preferably no two or more adjacent (centre and/or outer) areas of the image element array will be assigned to exhibit the same image, since this would effectively increase the size of the respective areas and could inadvertently give rise to a larger continuous outer area than that assigned to the centre image. This applies whether the adjacent areas lie within one unit cell or in adjacent unit cells.

Depending on the visual effect which is desired, it is not essential to register the array of focusing elements to the array of image elements: due to the matching periodicity between the arrays, an optically variable effect can be achieved without registration although there will be less control over the effect. As such, in preferred embodiments, the array of focusing elements and the array of image elements are registered to one another, preferably such that the centre area is aligned with the centre of the corresponding focussing element whereby the centre image is displayed when the security device is viewed along the normal to the plane of the security device. By registering the two arrays, the optically variable effect can be controlled, e.g. specifying which image will be viewed at which tilt angles. In combination with the above-described unit cell configuration this produces a particularly strong effect since, if registered as described, the "centre" image will be visible when viewed along the device normal and viewing angles close to the normal. Since documents will typically be examined from this perspective (at least initially), this ensures that the device presents a strong image in this default and easily identifiable position. In addition, the requirement for registration increases the security level of the device since the difficulty of producing an acceptable counterfeit version is increased.

Advantageously, the array of focusing elements and the array of image elements is configured such that the centre image is displayed when the security device is viewed at all angles between the normal and a threshold angle, along at least the first direction, the threshold angle being between 2 and 10 degrees from the normal, preferably between 2.5 and 5 degrees from the normal. Beyond the stated threshold angle, the centre image is no longer displayed and is replaced by an image assigned to an area outside the centre area. Preferably the full range of images displayed by the device can be viewed within a maximum tilt angle of about +/−15 degrees from the normal. The viewing angles over which each image is displayed can be measured for example by mounting the device on a table and positioning a camera to view the image displayed by the device. The relative angle between the table and the camera is measured and can be changed by either tilting the table or rotating the camera on a suitable arm. Thus to measure the viewing range of any one image, the camera is positioned such that it captures a view of the desired image and the table or camera tilted until that image is no longer seen by the camera. The angle through which the camera has moved relative to the table is measured and recorded.

It will be appreciated that the centre area does not include all of the image element positions in the unit cell and hence the unit cell will also include areas outside the centre area which are assigned to carry portions of respective images which are different from the centre image. As already explained, these "outer areas" may each comprise a single image element position or a group of such positions. Preferably, the unit cell comprises outer areas along at least the first direction, since the focusing elements are able to focus light in at least this direction. In the simplest case, a single outer area could be provided on each side outside the centre area, but preferably at least two outer areas are provided on each side of the centre area along the first direction, such that the display of several different images as the device is tilted can be accommodated. In particularly preferred cases, the same number of outer areas are provided on each side of the centre area along the first direction. This allows for the same number of different images to be displayed whichever sense the device is tilted in along the first direction. This can be particularly advantageous where the visual effect is an animation or three-dimensional effect since the apparent rate of (visual) change with tilt angle can be kept even on each side.

As noted above, the presently disclosed image element configuration is applicable to both one-dimensional and two-dimensional devices. Hence in some preferred embodiments, the focusing elements focus light in the first direction only and preferably are hemi-cylindrical lenses or mirrors. This results in a one-dimensional lenticular device.

In other preferred examples, the focusing elements are each adapted to focus light in at least the first direction and a second direction which is orthogonal (e.g. spherical lenses—other examples will be discussed below), and the focusing elements are arranged on a regular two-dimensional grid. Such two-dimensional focusing elements could be used with image element arrays of the same type as used with one-dimensional focusing elements, e.g. the image element positions being arranged along the first direction only within the unit cell, in which case the end result would again be a one-dimensional lenticular device. However, preferably, in this case the unit cell defines a two-dimensional set of image element positions, with the positions arranged along both the first and second directions. In this way, a two-dimensional optically variable effect can be achieved.

In a two-dimensional device the centre area could extend to the edge of the unit cell in one or more directions provided it does not in all directions. However, in preferred embodiments, the unit cell comprises outer areas outside the centre area along at least the first direction and the second direction, preferably along all directions. This is desirable in order to generate the optically variable effect when the device is tilted in the first and second directions and preferably in all directions. Advantageously, at least two outer areas are provided on each side of the centre area along the first and second directions, preferably along all directions. Preferably, the unit cell comprises the same number outer areas outside the centre area along at least the first and second directions, preferably along all directions. As in the case of the one-dimensional device, these options allow for several different images to be displayed upon tilting in each direction, and preferably the same number of different images in each case.

The particular layout of the image element array will depend at least in part on the layout of the focusing element array, but preferably each unit cell substantially corresponds to the footprint of one of the focusing elements (in terms of size and/or shape). It should be appreciated that the footprint of a focusing element is not necessarily determined solely by the shape of the focusing surface of the element. For example, a spherical or aspherical lens need not have a circular footprint but could be rectangular or square (examples will be shown below).

The number and arrangement of image element positions (advantageously at least 3 for a one-dimensional device, and at least 5 for a two-dimensional device) in each cell will depend on factors including the number of different images which it is desired to present and on whether the device is to operate in one or two dimensions, but preferably an odd, integral number of image element positions are defined within each unit cell. In this case the centre point of the unit cell will typically fall within one image element position, rather than at an intersection. Thus, each cell could define 5, 7, 9, 11, 13 . . . different image element positions for example. In theory there is no upper limit as to the number of image element positions which could be included, but, in practice, the image resolution will be reduced as the number of image element positions increases since an ever-decreasing proportion of the unit cell area (and hence of the device as a whole) will be available for display of each respective image. Also, in practical implementations the number of image element positions which can be formed in one unit cell will be limited by the resolution at which the image elements can be formed.

For example if using an ink-based printing method to form the image elements of a one-dimensional device with a minimum print dimension of 15 microns then for a 45 micron wide unit cell, a maximum of 3 image strips can be provided across the width of the cell. In a similar two-dimensional device with a unit cell of 60×60 microns, up to 16 (=4×4) image element positions can be included. Supposing however the minimum print dimension can be reduced to the level of around 1 micron (e.g. through the use of relief structures rather than printing to form the image elements) then the number of image elements may more likely be constrained by the desired visual effect and the size of image data file that can be managed during the origination of the print tool. The type of design effects which require a high number of matrix positions would include animation effects and more especially continuous and horizontal parallax effects. Even then, however, there is no significant benefit in having more than one image element position per degree of angular tilt since smaller angular increments cannot generally be resolved by the viewer. Since in practice devices will typically be viewed over a viewing angle range of about 30 to 35 degrees in each orthogonal axis, then a practical upper limit to the number of image element positions in each unit cell is around 30×30 (i.e. 900), which can be used to achieve smooth parallax effects or animation effects. However, for a 30 micron dimension focusing element and unit cell this would require the capability to form a data element with dimensions of 1 micron.

In practice however even 2 to 3 degree angular steps may be small enough to appear non-granular and therefore a 9×9 or 11×11 array of image elements per unit cell would give a good appearance provided the data elements can be formed with circa 3 micron dimension. A further factor is that the focal spot (i.e. the portion of the image element array which is directed to the viewer by each focusing element) will in practice typically have an effective width or diameter of not less than 1.5-2 microns for a 30 micron lens base dimension and hence image elements with a dimension less than 2 microns would not be resolvable. As such, for a 30 micron focusing element, the preferred maximum number of image elements per unit cell would be around 15, 11 or 9 (for a one-dimensional device) and 225 (=15×15), 121 (11×11) or 81 (9×9) (for a two-dimensional device).

The centre area may or may not have the same shape as that of the unit cell. In a two-dimensional device, preferably, the centre area is not elongate but may for example be substantially square, rectangular, circular or hexagonal. In this way, in a two-dimensional device, the effect of the sub-set will be substantially symmetrical.

As noted above, some of the image element positions across the device may remain empty depending on the image to which they contribute and indeed one or more of the images may be blank at least in a region of the device. In a particularly preferred embodiment, at least across a region of the device in which the respective images corresponding to the outer areas include indicia, the centre image is blank, whereby the image elements carried by the centre area are empty in each unit cell across the region of the device. To the viewer, this will appear as a blank region of the device at small tilt angles (when the centre image, presented the centre area, is displayed), which is replaced by indicia when the device is tilted further. As the device is tilted from one extreme to another, through its centre, rather than transitioning directly from an indicia displayed by a first image to another indicia displayed by a second image, the device will appear to go blank between displayed indicia (where the centre image is displayed). This visually separates the first and second image, which although located in the same region will not be seen to overlap. Rather, one will be cleanly replaced by the other.

A similar effect can be achieved where the centre image is a solid block of colour ("colour" includes achromatic tones such as white, grey and black as well as hues such as red, green etc.). Thus in another preferred example, at least across a region of the device in which the respective images corresponding to the outer areas include indicia, the centre image is a solid block colour, whereby the image elements carried by the centre area are of the same solid colour in each unit cell across the region of the device. The colour could be selected to match a background material, e.g. the substrate of a document of value on which the device is provided, in which case the presence of the device may be concealed when the centre image is displayed.

The centre image could also take any other form, for instance a view of a three-dimensional object, a step in an animation sequence, or a letter, number, symbol or other indicia.

The image element positions defined within each unit cell could be spaced from one another, but in preferred embodiments the image element positions abut one another and substantially fill the unit cell. Again this contributes to a strong visual impact since the resolution and intensity of the images is kept high.

In all embodiments, the images could each take any desired form (including solid colour/blank as mentioned already) but in preferred examples, at least some of the images (e.g. the centre image or any of the images corresponding to the outer areas) comprises one of a letter, number, symbol, character, logo, portrait or graphic. The various images are preferably different from one another but one or more (not all) of them could be the same if the further considerations mentioned above are taken into account. Each image element will be a portion, e.g. a pixel, of the corresponding image. The images could for example comprise a sequence of letters or numbers, e.g. "A", "B", "C", "D" and "E", or a sequence of animation frames, or different views of a three-dimensional object or scene. In some preferred examples, all of the images include a common image component (or "keyline") which is displayed by the security device at all viewing angles. The presence of such a component, which is continuously visible as the device is tilted, assists the viewer in comparing the appearances of the device at different angles to one another, and thereby appreciating the changing visual effect. In one particularly effective implementation, the common image component is an outline surrounding a region, the contents of which region vary (e.g. in terms of colour) between the various images. Thus the keyline can act as a framing element. Alternatively the keyline could be formed as a border around an internal portion of an image, or as a section of an image.

In two-dimensional devices, the focusing elements and image elements can be arranged in various different ways. In a preferred example, the grid on which the focusing elements are arranged is an orthogonal grid and the unit cell is square or rectangular. In other preferred implementations, the grid on which the focusing elements are arranged is a hexagonal grid (e.g. close-packed) and the unit cell is a hexagon, preferably a regular hexagon. Unit cells with equal side-lengths are preferred in order that the rate of visual change is substantially equal when the device is tilted in orthogonal directions.

In preferred examples, the focusing elements are lenses or mirrors, and in two-dimensional devices, advantageously have spherical or apsherical focussing surfaces. The focussing elements should be capable of directing light from any of the image elements in the array (which typically will all lie in the same plane) to the viewer, depending on the viewing angle. The focal power could be different in different directions, e.g. to obtain an effect in which an image appears to go out of focus as the device is tilted in one direction, but preferably each focusing element has substantially equal focal power in each of the at least two orthogonal directions. In particularly preferred embodiments, the focusing elements have substantially equal focal power in all directions (i.e. each has infinite rotational symmetry), such as is the case in spherical lenses and some aspherical lenses. Preferably the focal length will be substantially the same (e.g. to within +/−10 microns, more preferably +/−5 microns) for all viewing angles along each direction, most preferably in all directions.

The periodicity of the focusing element array and therefore maximum base dimension (footprint) of the individual focusing elements is related to the device thickness and is preferably in the range 5 to 200 microns, preferably 10 to 70 microns, most preferably 20 to 40 microns. This applies in both of the two dimensions. The f-number for the focusing elements is preferably in the range 0.25 to 16, more preferably 0.5 to 10. Typically the f-number will range between 0.7 and 8, more especially 1 to 4. The f-number equals f/D where f is focal length and D is the base diameter of the focusing element. Since f approximates to r/(n−1), where n is the refractive index (=approx. 1.45 to 1.5) and r is the radius, the f-number approximates to 2r. For a plano-convex or concave lens the f-number cannot be less than 1.0 (since the maximum value of D is 2r). The focusing elements can be formed in various ways, but are preferably made via a process of thermal embossing or cast-cure replication. Alternatively, printed focusing elements could be employed as described in U.S. Pat. No. 6,856,462. If the focusing elements are mirrors, a reflective layer may also be applied to the focussing surface.

In some preferred embodiments, the image elements are defined by inks. Preferred printing techniques for forming the image elements include those disclosed in WO-A-2008/000350, WO-A-2011/102800 and EP-A-2460667. Thus, the image elements can be simply printed onto the substrate although it is also possible to define the image elements using a relief structure. This enables much thinner devices to be constructed which is particularly beneficial when used with security documents. Suitable relief structures can be formed by embossing or cast-curing into or onto a substrate. Of the two processes mentioned, cast-curing provides higher fidelity of replication.

A variety of different relief structures can be used as will described in more detail below. However, the image elements could be created by embossing/cast-curing the images as diffraction grating structures. Differing parts of the image could be differentiated by the use of differing pitches or different orientations of grating providing regions with a different diffractive colour. Alternative (and/or additional differentiating) image structures are anti-reflection structures such as moth-eye (see for example WO-A-2005/106601), zero-order diffraction structures, stepped surface relief optical structures known as Aztec structures (see for example WO-A-2005/115119) or simple scattering structures. For most applications, these structures could be partially or fully metallised to enhance brightness and contrast. Typically, the width of each image element position may be less than 50 microns, preferably less than 40 microns, more preferably less than 20 microns, most preferably in the range 5 to 10 microns.

Preferably, the array of image elements is located approximately in the focal plane of the focusing elements. Typical thicknesses of security devices according to the invention are 5 to 200 microns, more preferably 10 to 70 microns, with lens heights of 1 to 70 microns, more preferably 5 to 25 microns. For example, devices with thicknesses in the range 50 to 200 microns may be suitable for use in structures such as over-laminates in cards such as drivers licenses and other forms of identity document, as well as in other structures such as high security labels. Suitable maximum image element widths (related to the device thickness) are accordingly 25 to 50 microns respectively. Devices with thicknesses in the range 65 to 75 microns may be suitable for devices located across windowed and half-windowed areas of polymer banknotes for example. The corresponding maximum image element widths are accordingly circa 30 to 37 microns respectively. Devices with thicknesses of up to 35 microns may be suitable for application to documents such as paper banknotes in the form of strips, patches or security threads, and also devices applied on to polymer banknotes where both the lenses and the image elements are located on the same side of the document substrate.

If the image elements are formed as a relief structure, the relief depth depends on the method used to form the relief. Where the relief is provided by a diffractive grating the depth would typically be in the range 0.05-1 μm and where a coarser non-diffractive relief structure is used, the relief depth is preferably in the range 0.5 to 10 μm and even more preferably 1 to 5 μm.

Preferably, the security device is formed as a security thread, strip, foil, insert, label or patch. Such devices can be applied to or incorporated into articles such as documents of value using well known techniques, including as a windowed thread, or as a strip covering an aperture in a document. Preferably, the article is selected from banknotes, cheques, passports, identity cards, certificates of authenticity, fiscal stamps and other documents for securing value or personal identity.

Alternatively, such articles can be provided with integrally formed security devices of the sort described above. Thus in preferred embodiments, the article comprises a substrate with a transparent portion, on opposite sides of which the focusing elements and image elements respectively are provided.

As already described, the invention further provides a method of manufacturing a security device as set out above. Preferably, the method involves overlapping the array of focusing elements and the array of image elements in registration to one another, preferably such that the centre area in each unit cell is aligned with the centre of the corresponding focussing element whereby the centre image is displayed when the security device is viewed along the normal to the plane of the security device, in order to provide the additional benefits already mentioned.

Examples of security devices will now be described and contrasted with comparative examples with reference to the accompanying drawings, in which.

Figure 6:
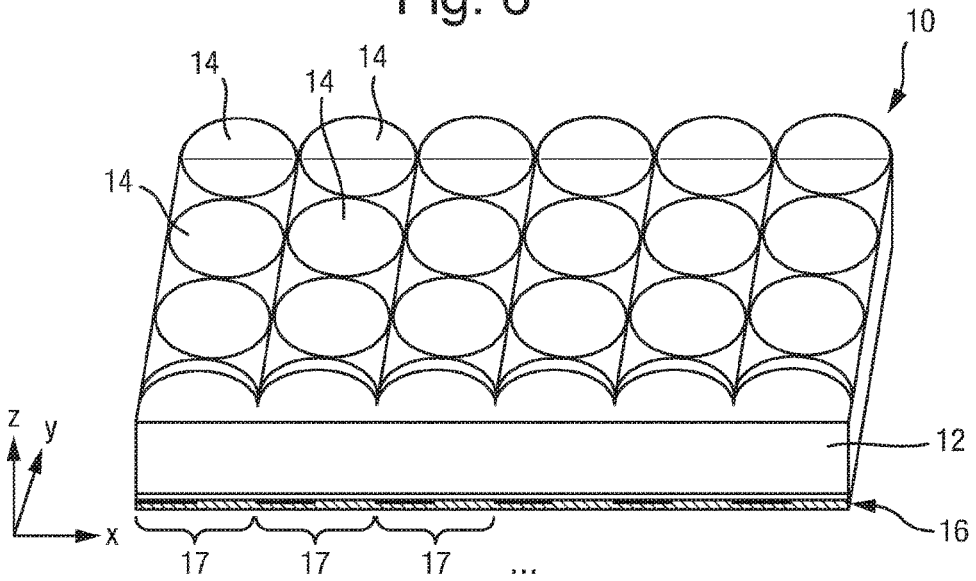
FIG. 6 is a perspective view of a security device in accordance with a second embodiment of the present invention.
Figure 7A:
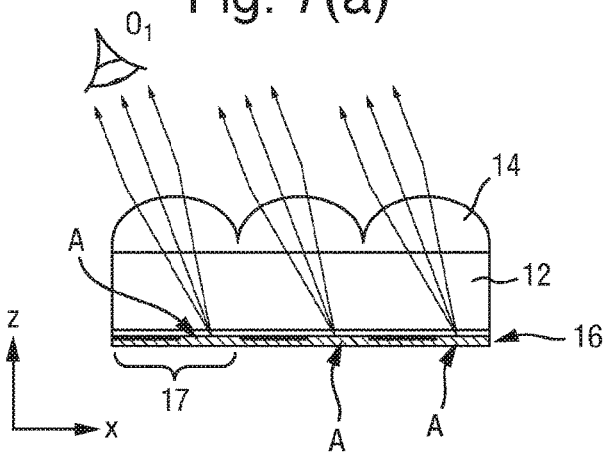
Figure 7B:
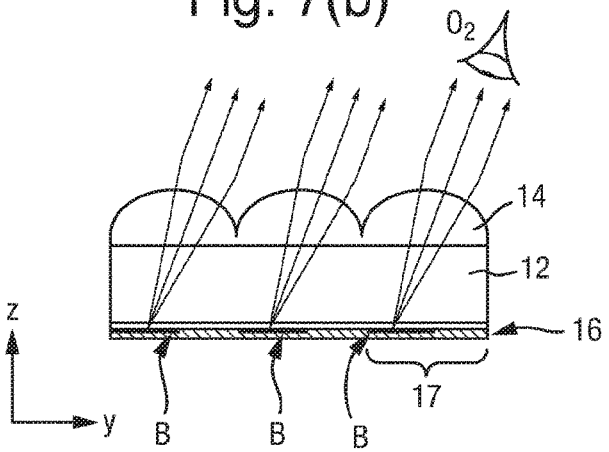
Figure 8:
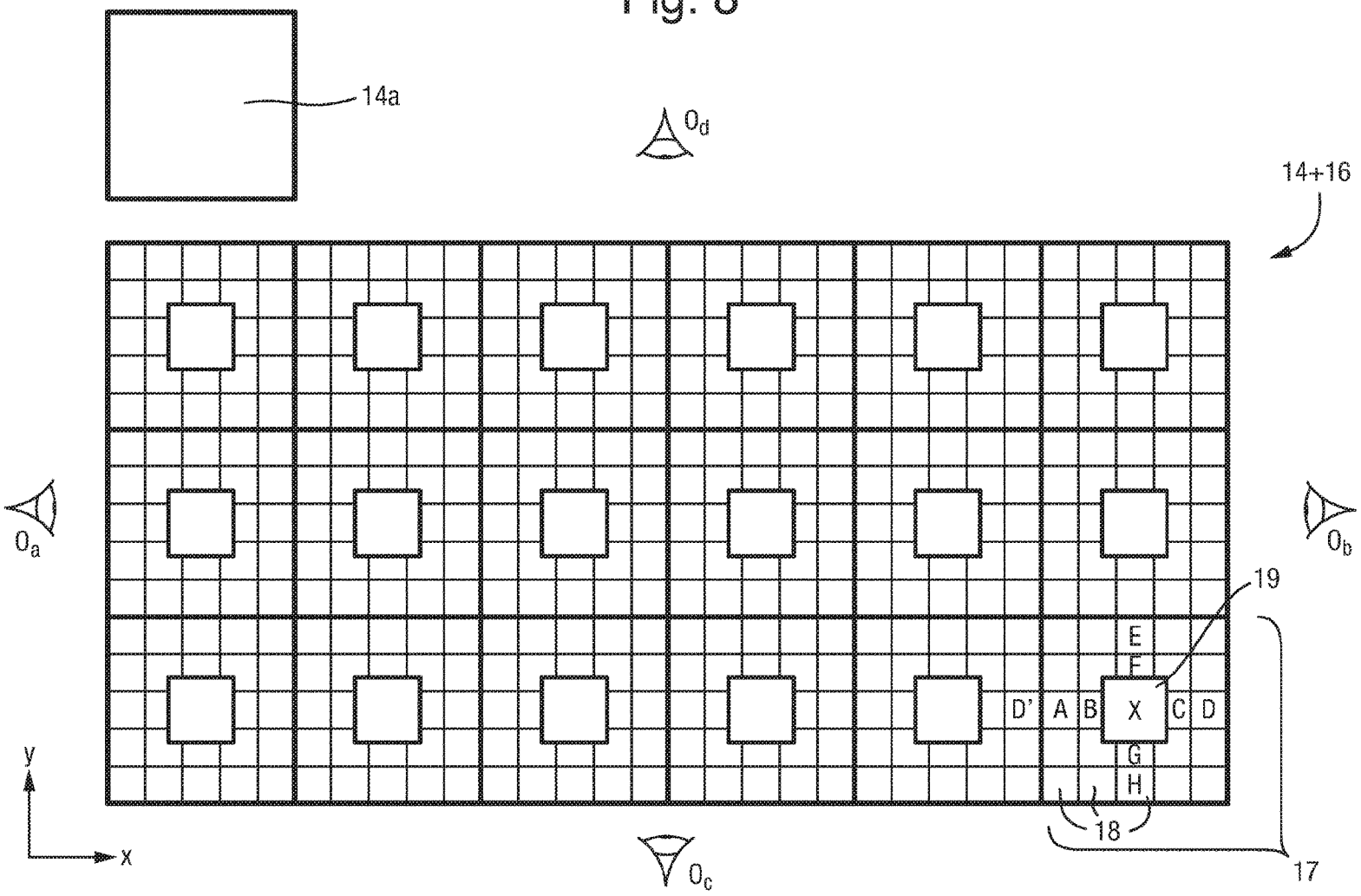
Figure 9:
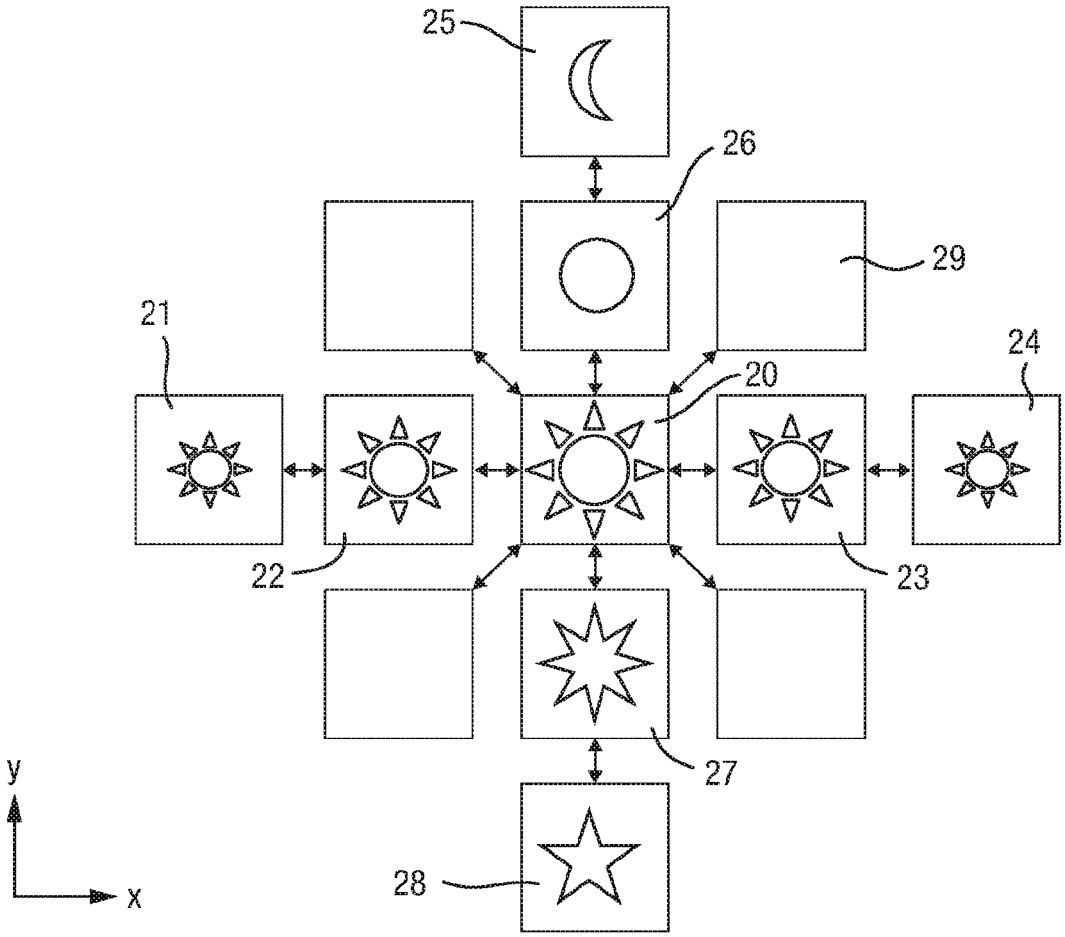
Figure 10:
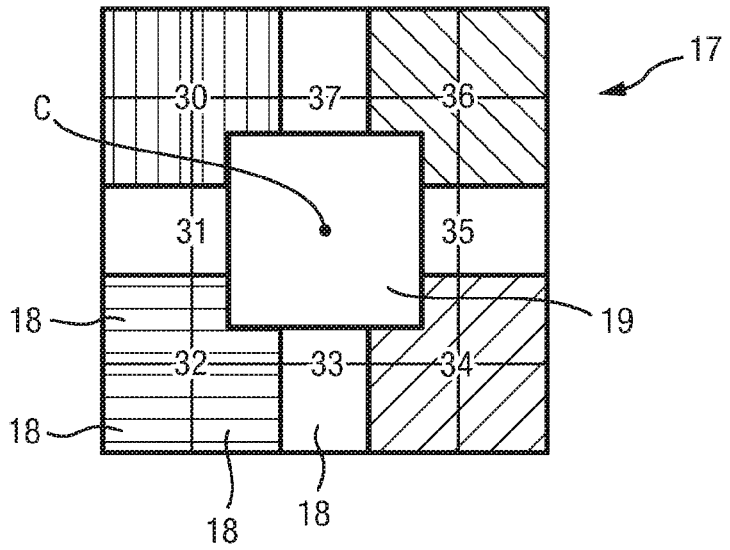
Figure 11:
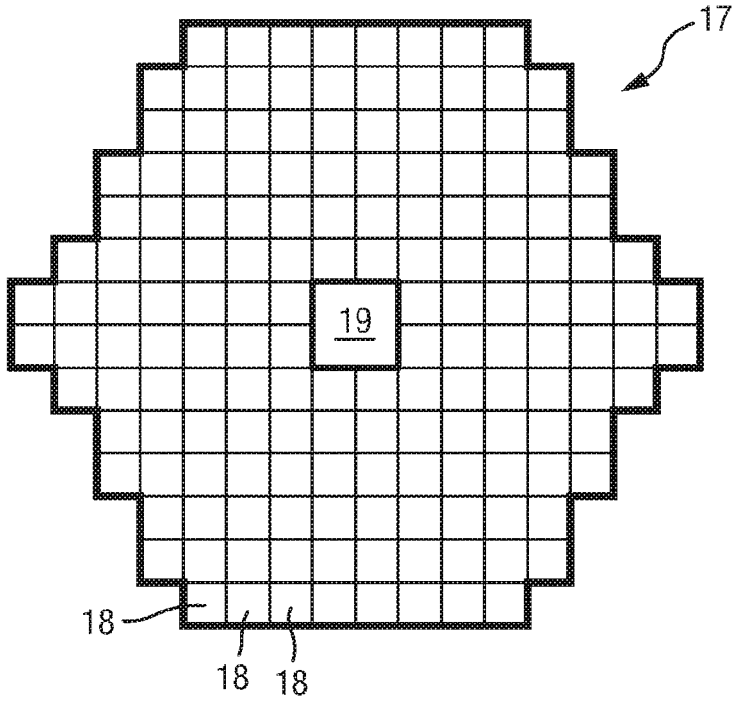
Figure 12:
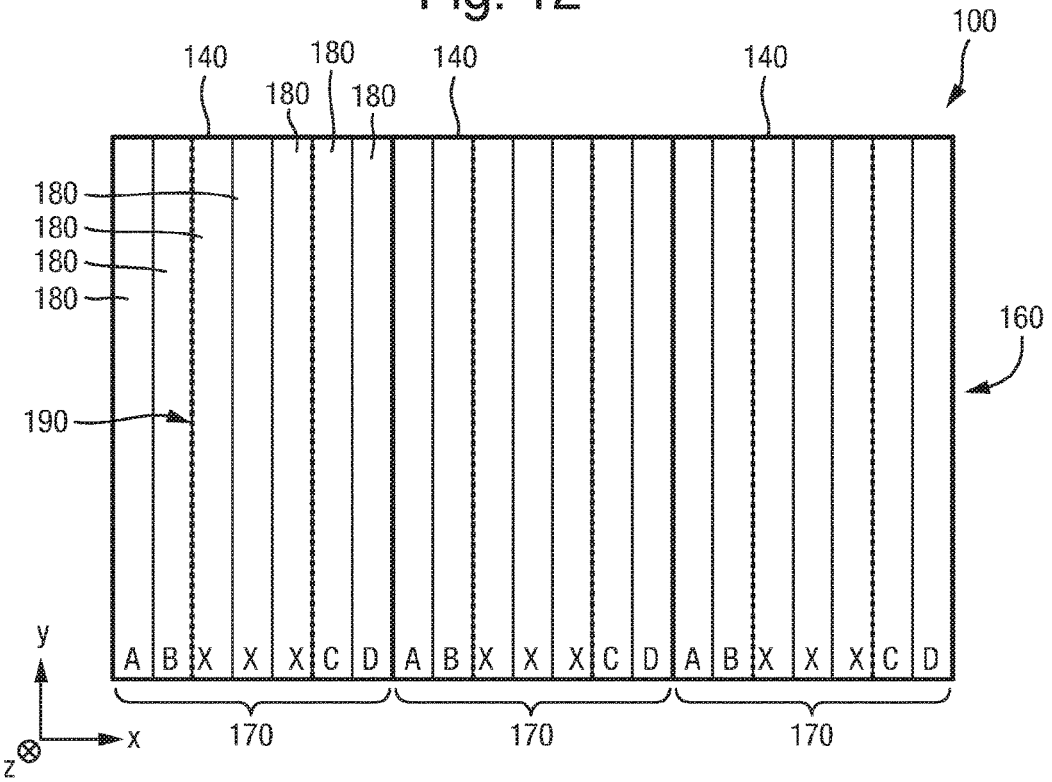
Figure 13:
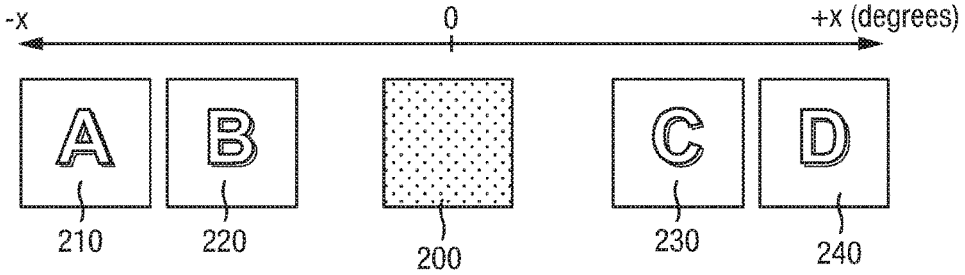
Figure 14:
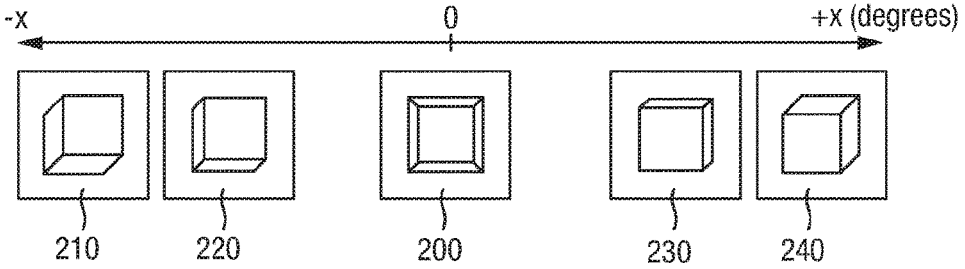
Figure 15:
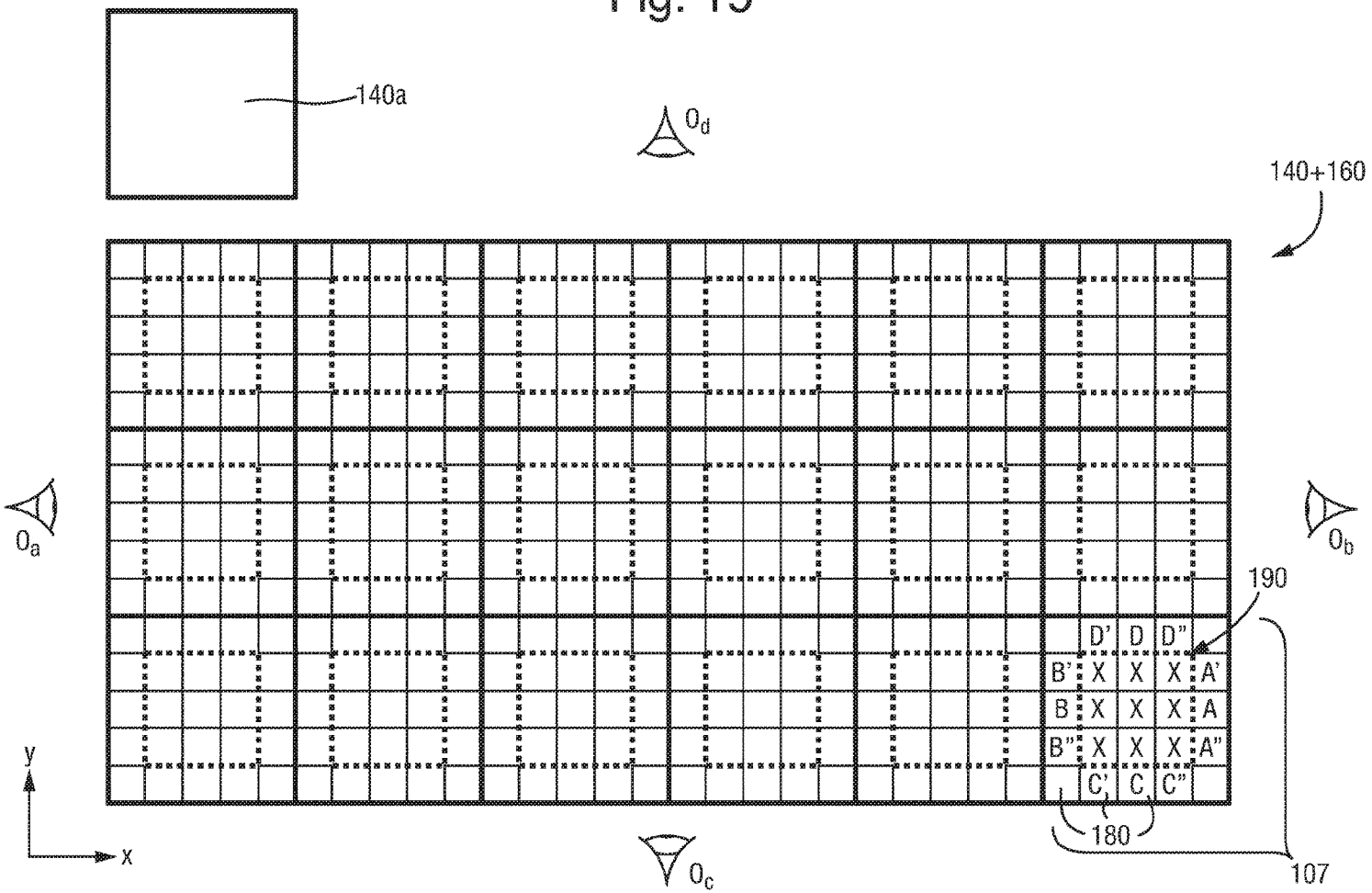
Figure 16:
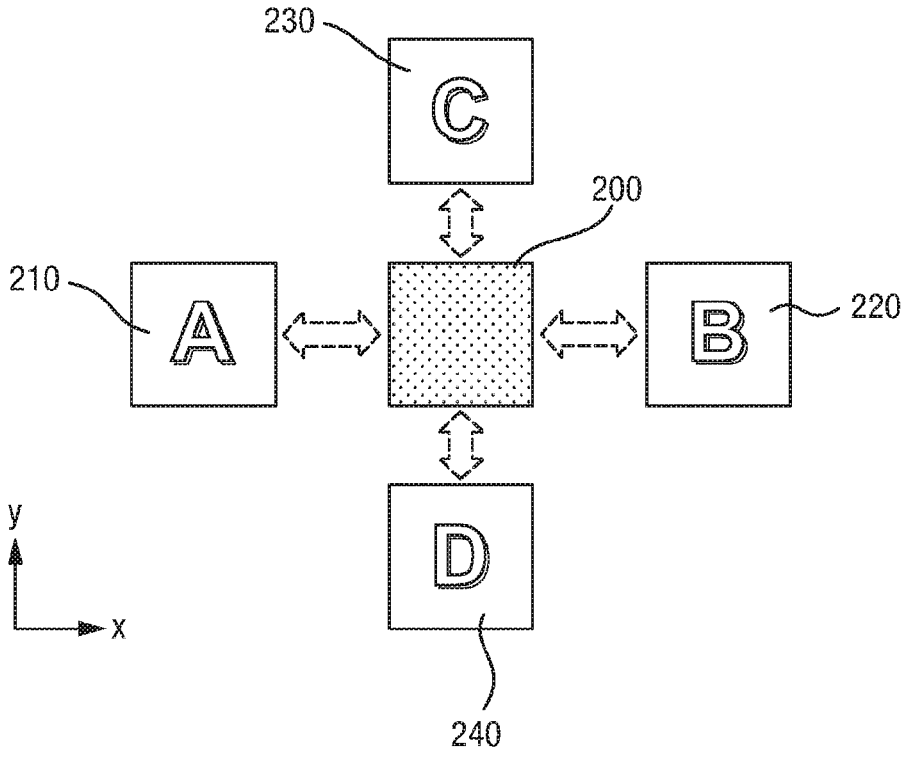
Figure 17A:
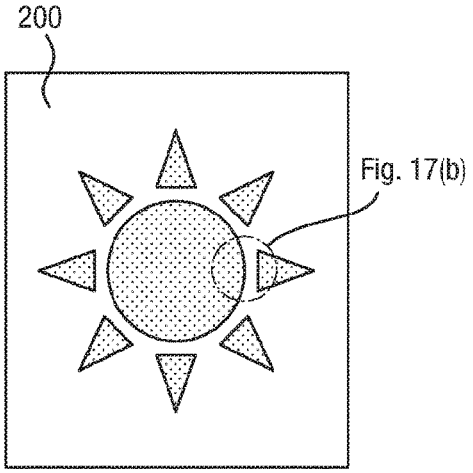
Figure 17B:
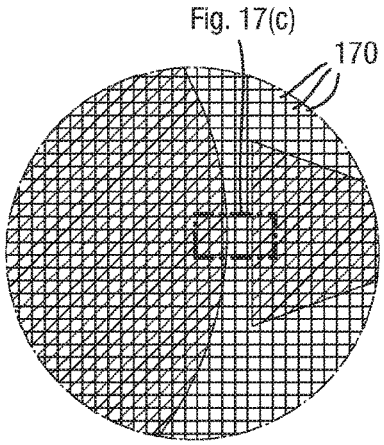
Figure 17C:
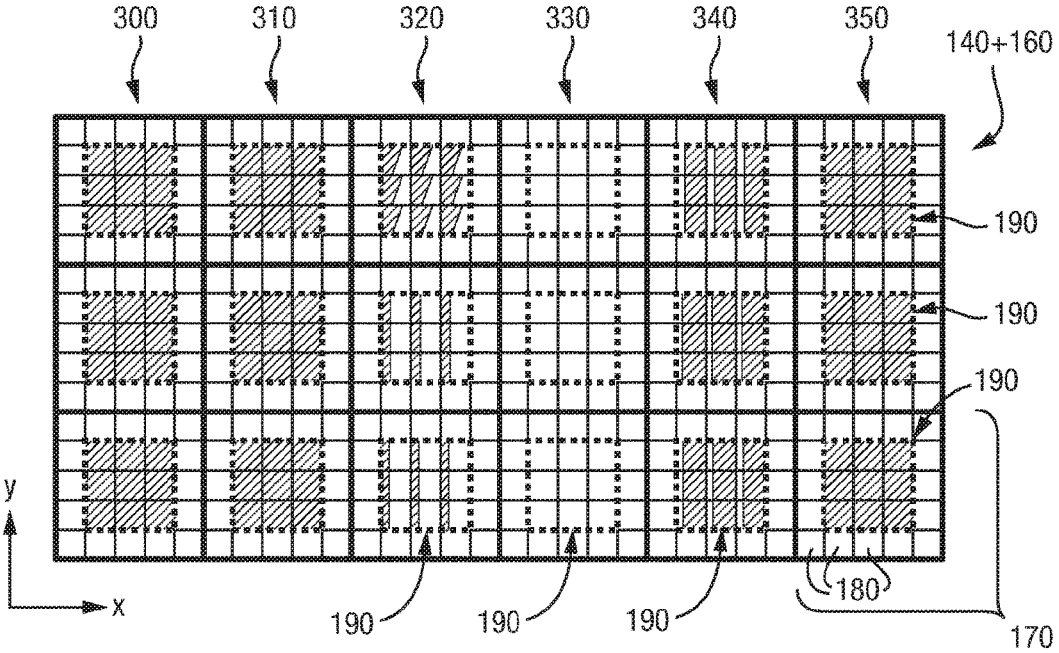
Figure 18:
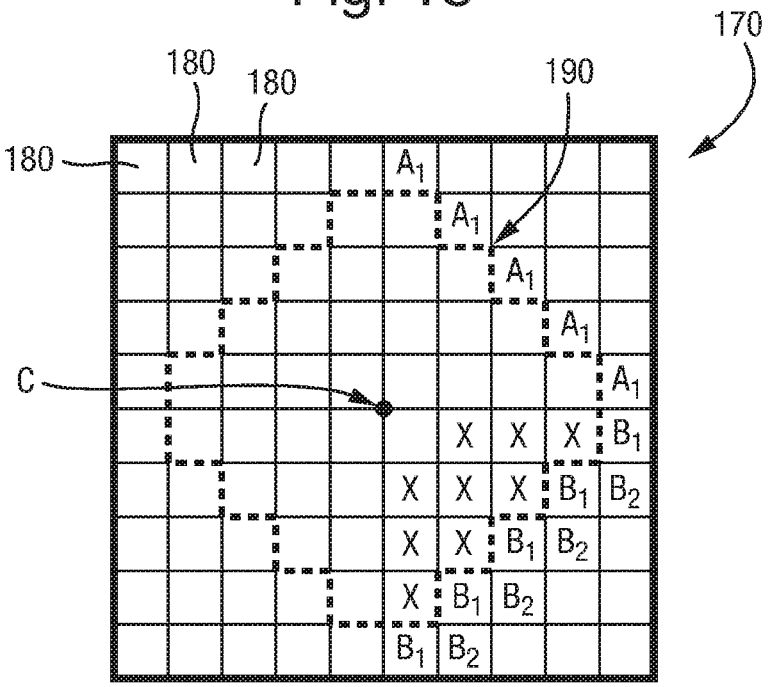
Figure 19:
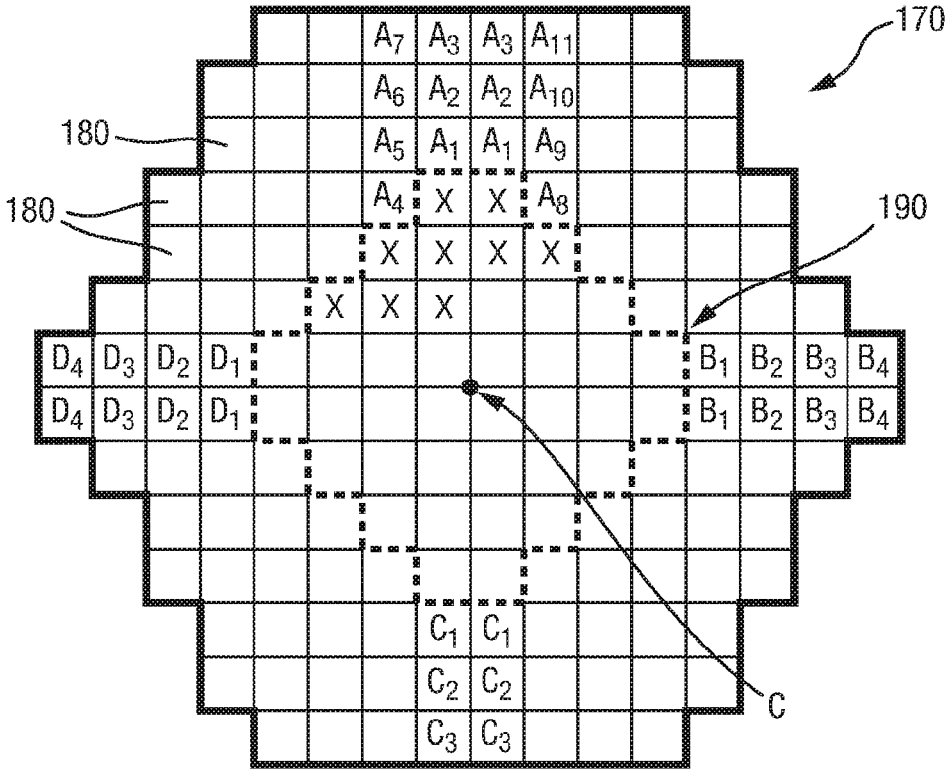
Figure 20:
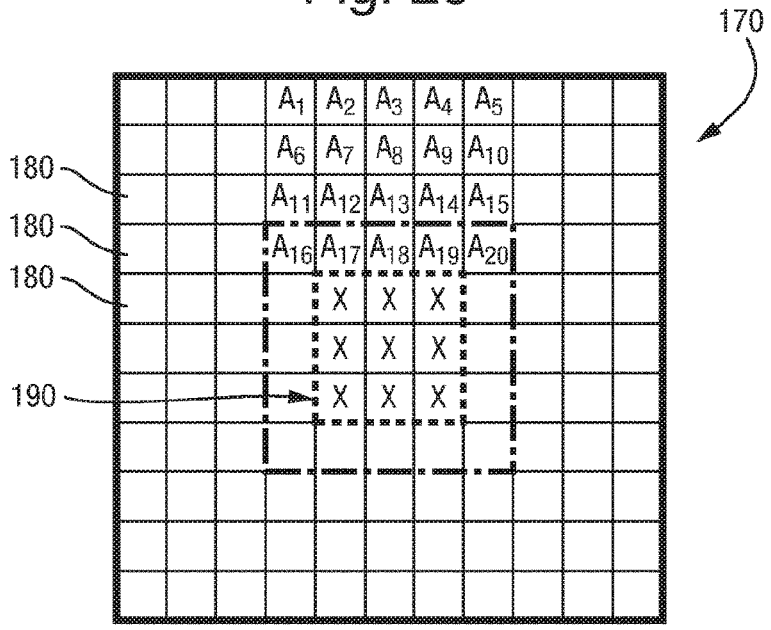
Figure 21:
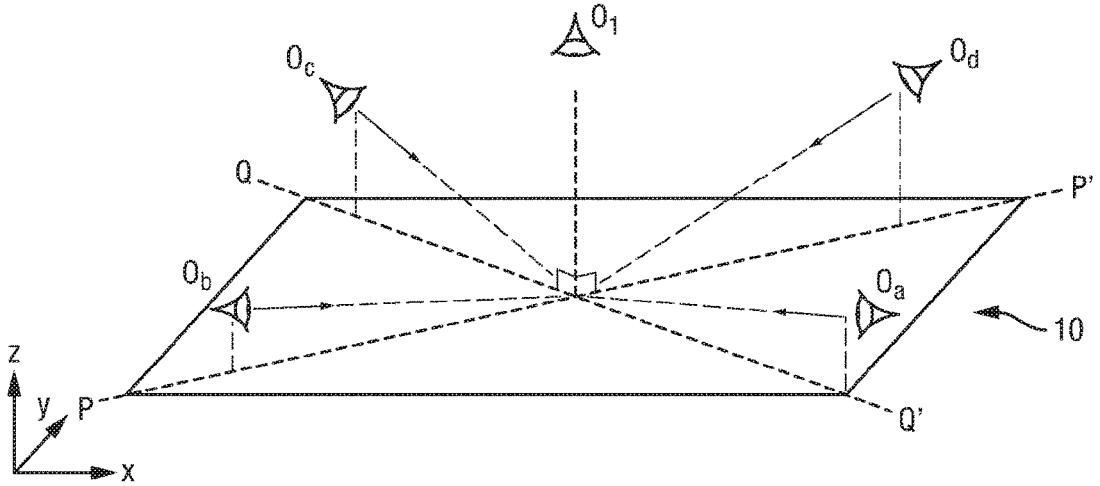
Figure 22:
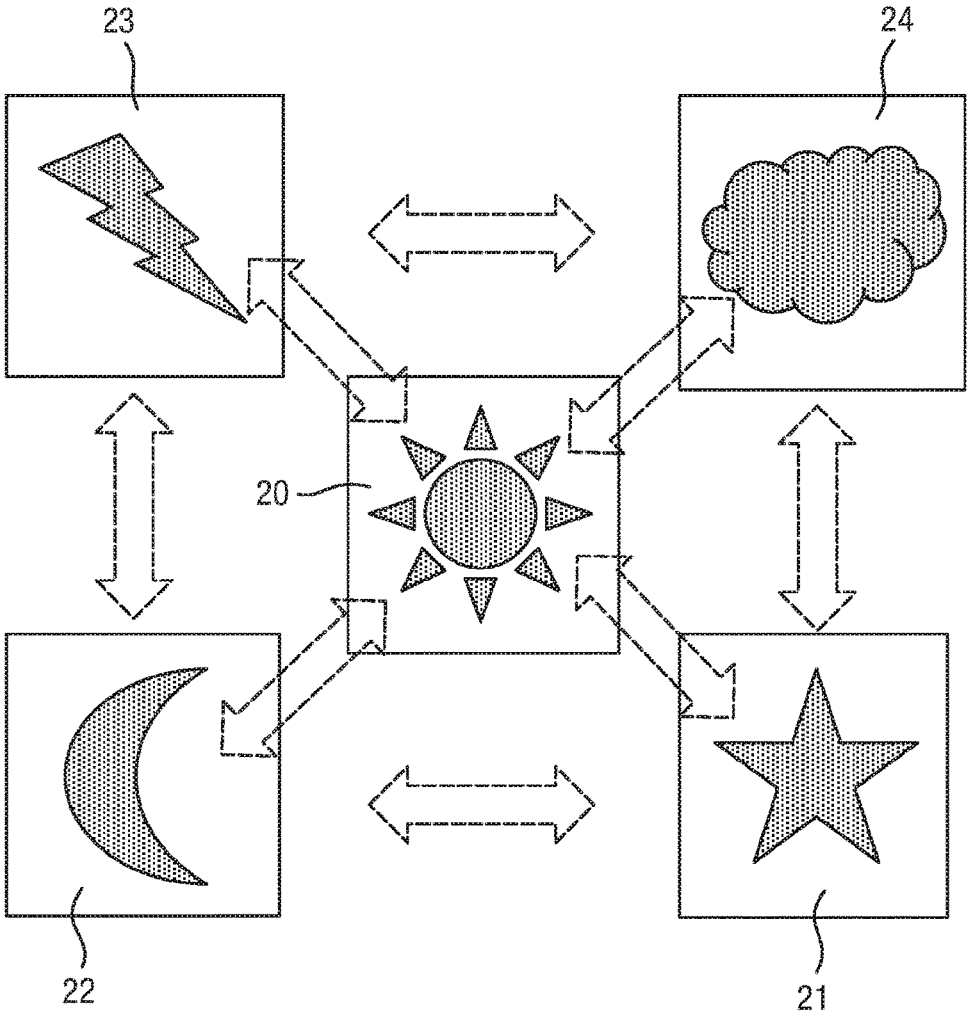
Figure 23:
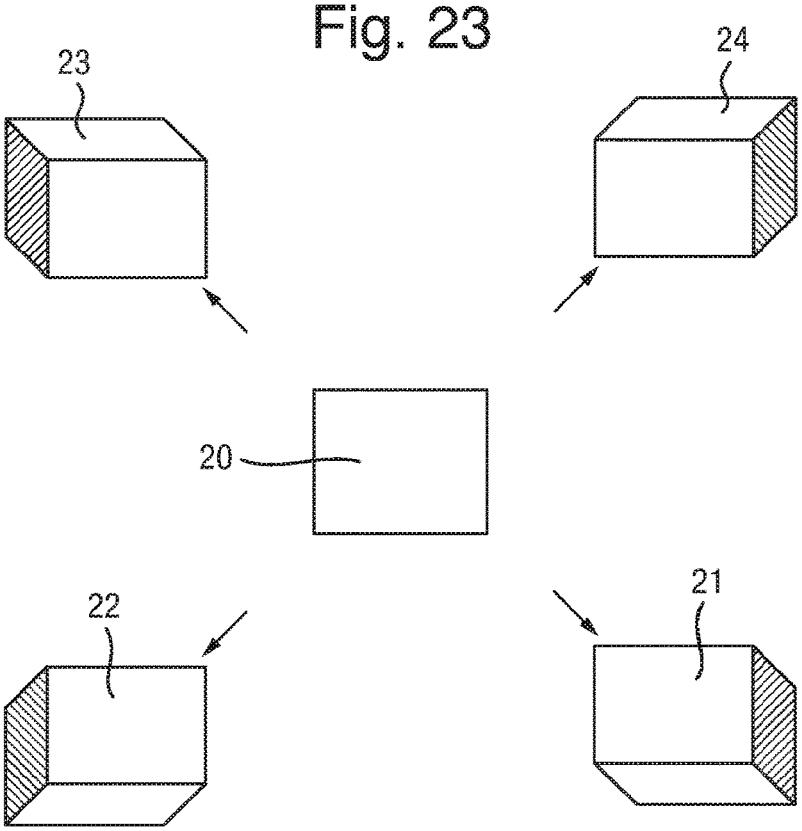
Figure 24:
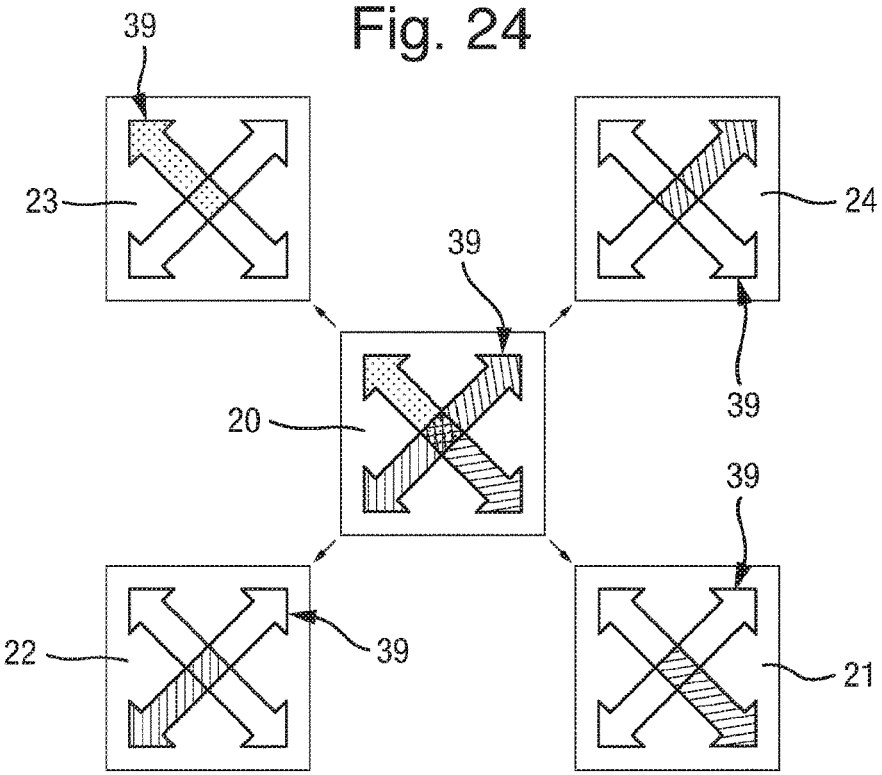
Figure 25A:
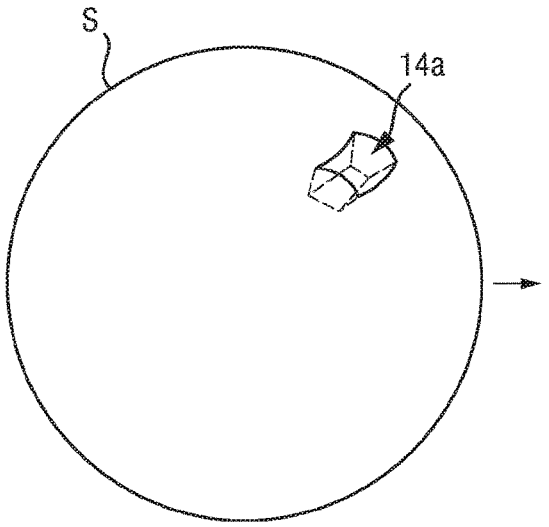
Figure 25B:
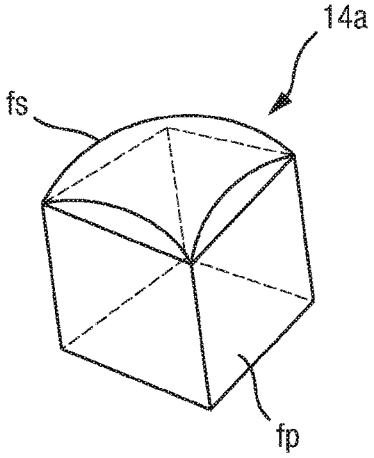
Figure 26:
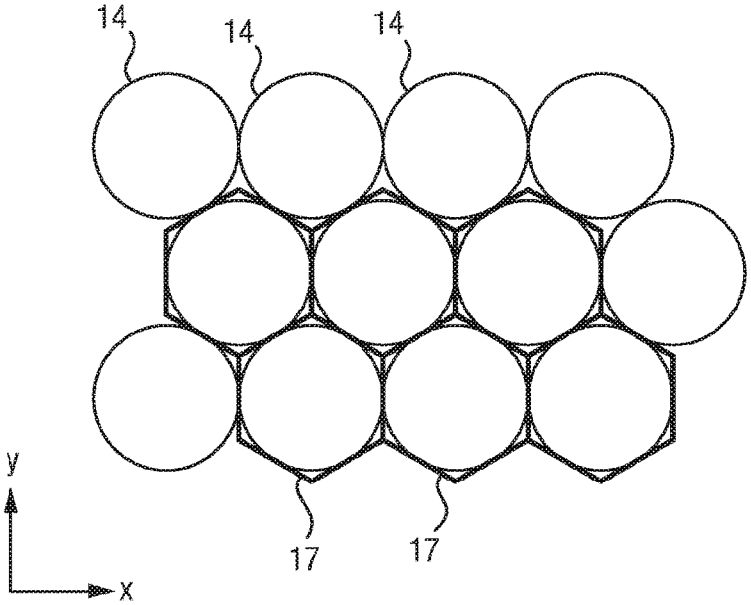
Figure 27:
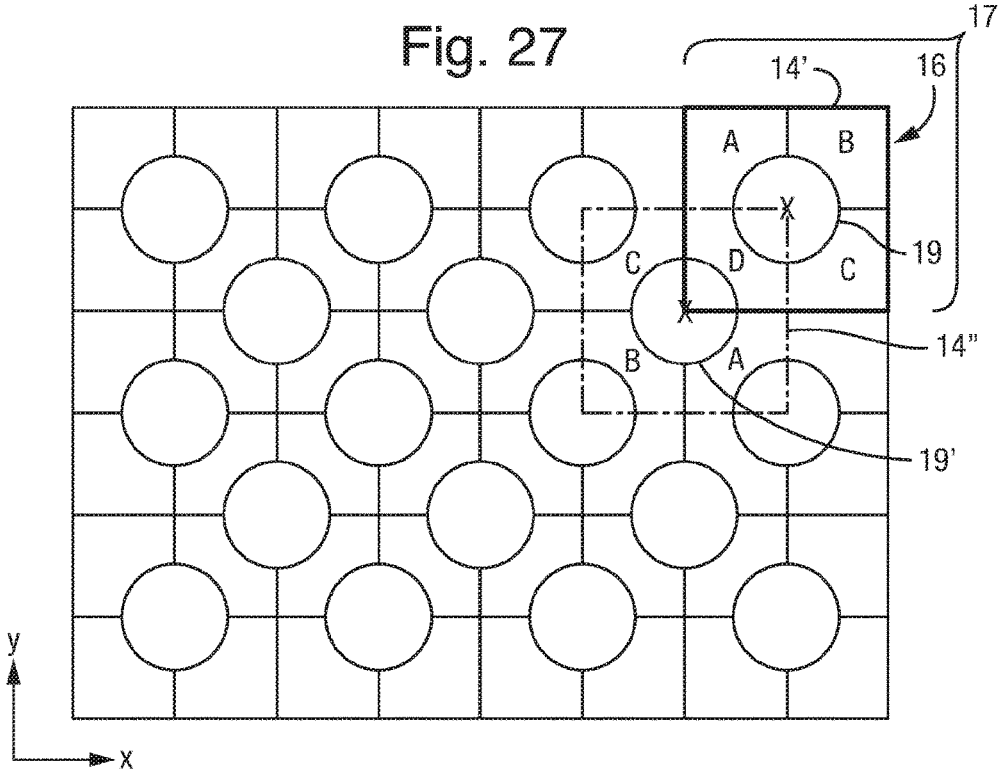
Figure 28:
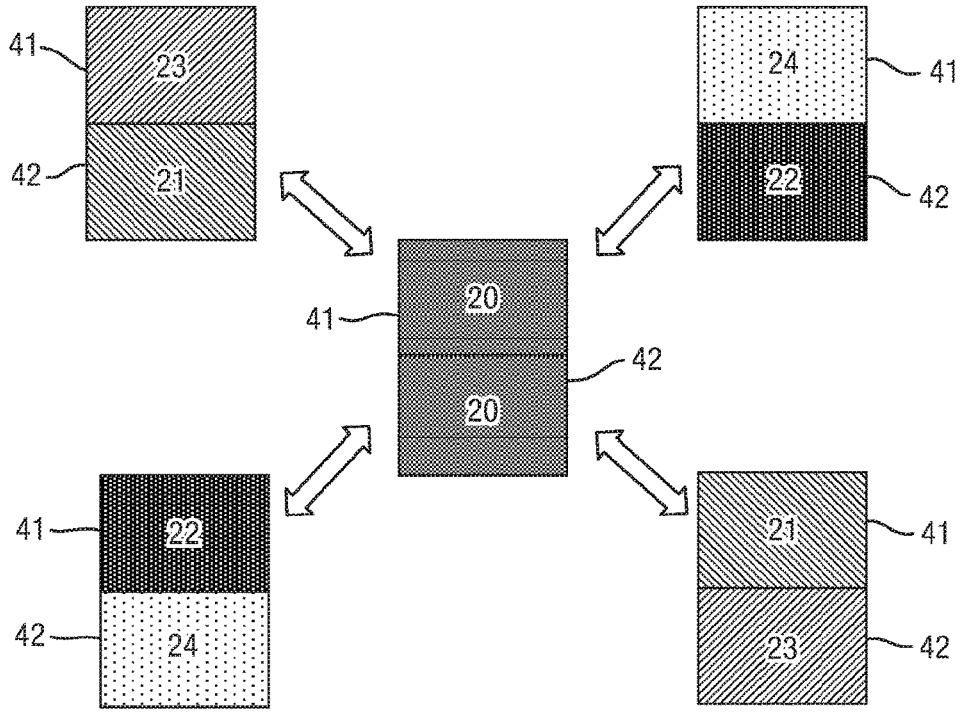
Figure 30A:
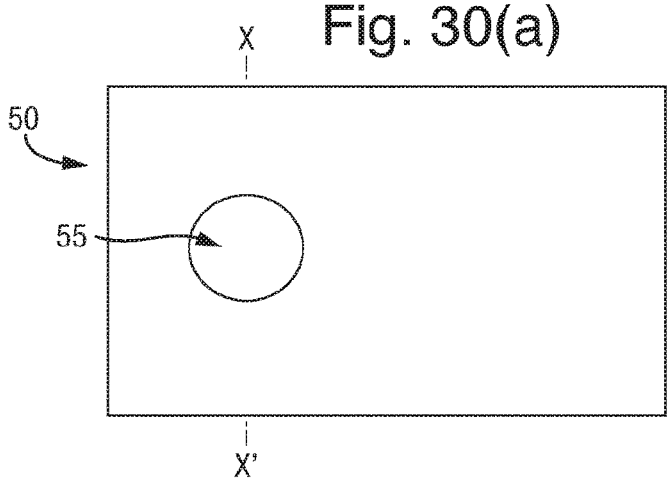
Figure 30B:
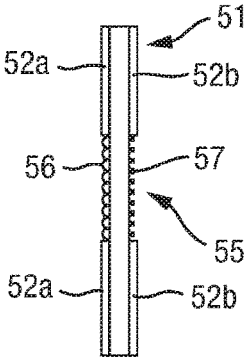
Figure 31A:
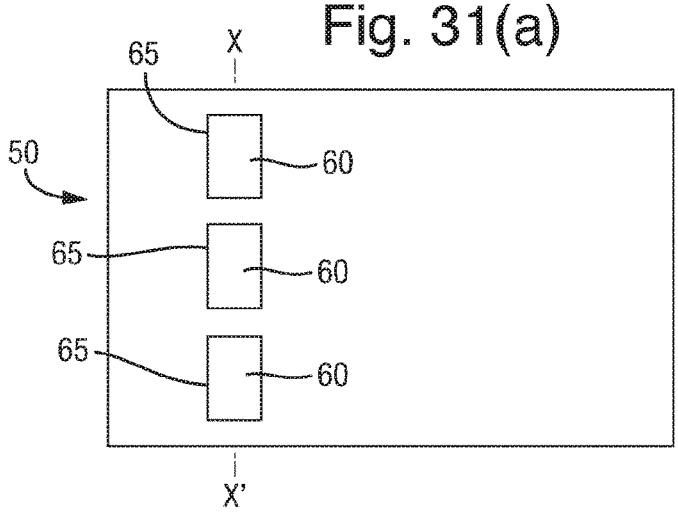
Figure 31B:
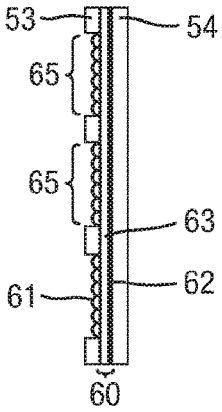
Figure 32A:
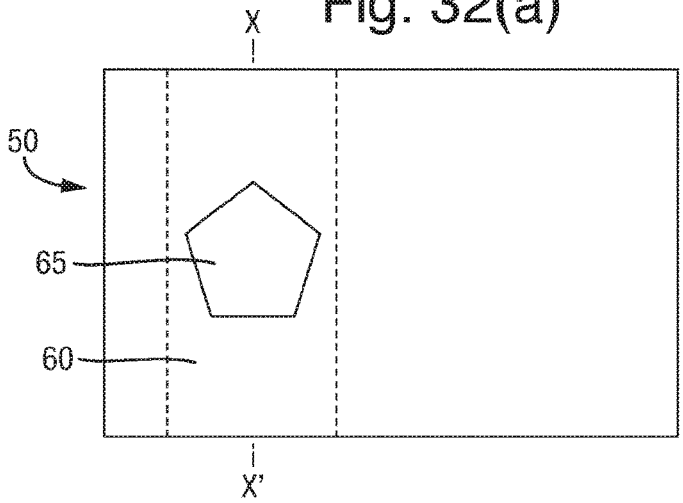
Figure 32B:
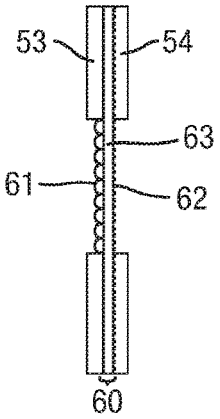
Figure 33A:
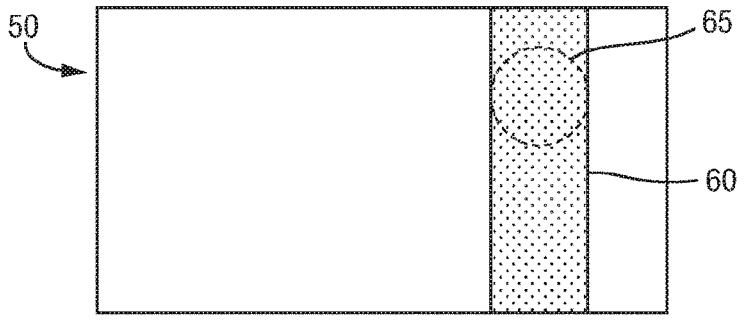
Figure 33C:
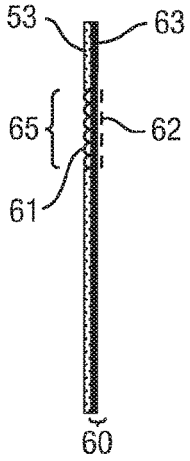
Figure 33B:
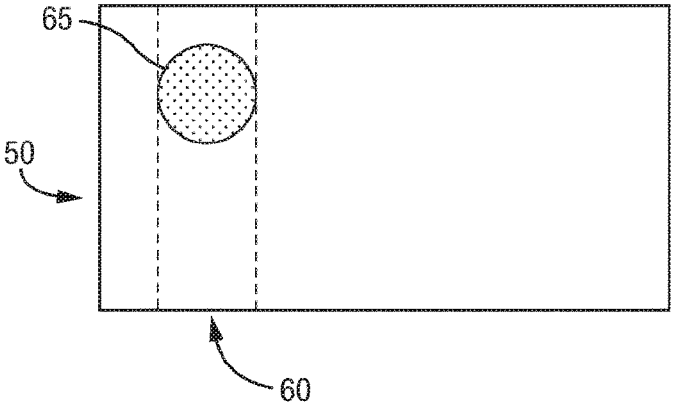

FIGS. 7*a* and 7*b* are cross-sections through portions of the device shown in FIG. 6, along the X axis and Y axis respectively;

FIG. 8 schematically depicts an arrangement of focusing elements and image elements in a security device in accordance with a second embodiment of the invention;

FIG. 9 depicts examples of images that may be displayed by the security device of FIG. 8 at various viewing angles;

FIGS. 10 and 11 show two further exemplary unit cells on which image element arrays in accordance with embodiments of the present invention may be based;

FIG. 12 is a plan view of a security device in accordance with a third embodiment of the present invention;

FIGS. 13 and 14 depict examples of images that may be displayed by the security device of FIG. 12 at various viewing angles;

FIG. 15 schematically depicts an arrangement of focusing elements and image elements in a security device in accordance with a fourth embodiment of the invention;

FIG. 16 depicts examples of images that may be displayed by the security device of FIG. 15 at various viewing angles;

FIGS. 17*a*, 17*b* and 17*c* depict (a) an example of an image displayed by a security device according to the fourth embodiment of the invention; (b) an enlarged portion of the image divided into unit cell areas; and (c) a further-enlarged portion of the image as incorporated into an image element array in accordance with an example of the fourth embodiment of the present invention;

FIGS. 18, 19 and 20 show three further exemplary unit cells on which image element arrays in accordance with embodiments of the present invention may be based;

FIG. 21 shows an exemplary security device and illustrates the positions of five observers at different viewing angles FIGS. 22, 23 and 24 respectively depict three examples of sets of five images which may be viewed by the five observers shown in FIG. 21 in three different embodiments of the invention;

FIGS. 25*a* and 25*b* schematically depict an exemplary focusing element suitable for use in embodiments of the present invention;

FIG. 26 depicts an array of focusing elements in accordance with a further embodiment of the invention and a corresponding array of unit cells forming part of an image element array;

FIG. 27 schematically depicts an image element array in accordance with a further embodiment of the present invention;

FIG. 28 depicts a security device in accordance with a further embodiment of the invention and its appearance from the points of view of the five observers shown in FIG. 21;

FIGS. 29*a* to 29*i* illustrate different examples of relief structures which may be used to define image elements in accordance with the present invention;

FIGS. 30, 31 and 32 show three exemplary articles carrying security devices in accordance with embodiments of the present invention (a) in plan view, and (b) in cross-section; and FIG. 33 illustrates a further embodiment of an article carrying a security device in accordance with the present invention, (a) in front view, (b) in back view and (c) in cross-section.

Figure 1:
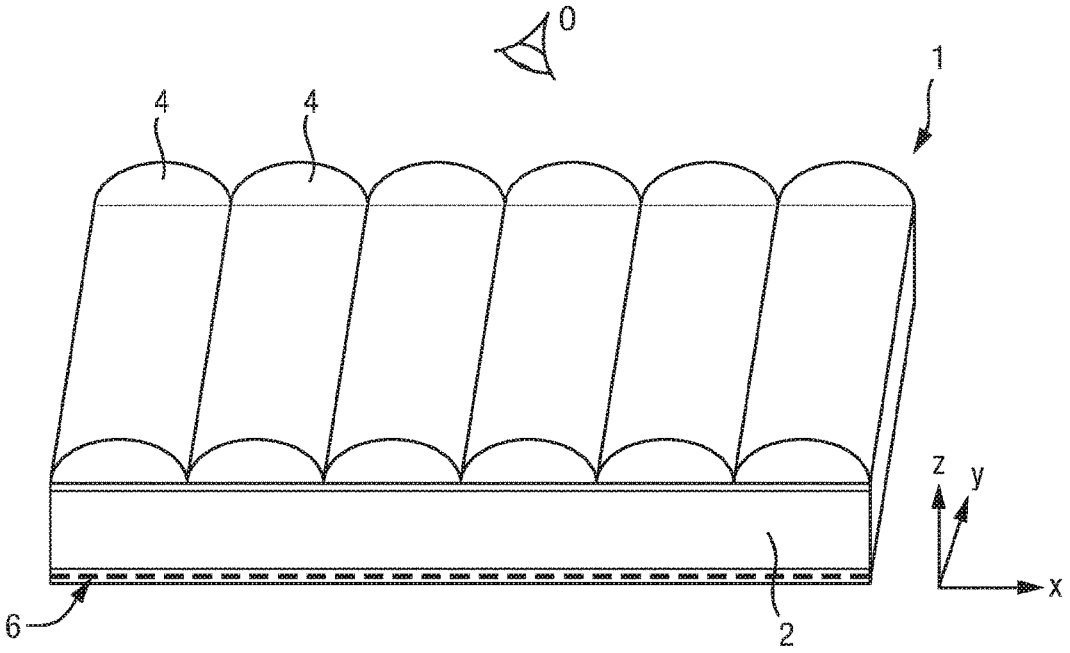
FIG. 1 is a perspective view of a comparative example of a security device.
Figure 2:
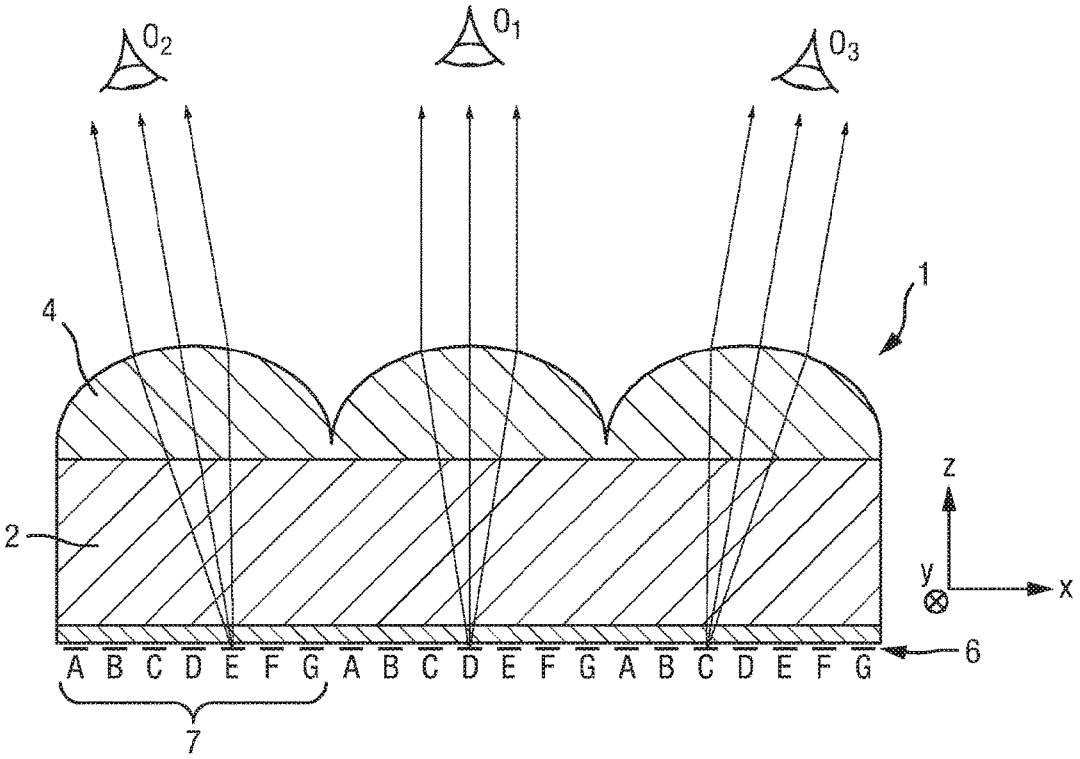
FIG. 2 is a cross-section through a portion of the security device shown in FIG. 1.

A comparative example of a lenticular device 1 is shown in FIGS. 1 and 2 in order to illustrate certain principles of operation. FIG. 1 shows the device in perspective and it will be seen that an array of cylindrical lenses 4 is arranged on a transparent substrate 2. An array of image elements or "strips" 6 is provided on the opposite side of substrate 2 underlying (and overlapping with) the cylindrical lenses and, as shown best in the cross-section of FIG. 2, each of the image strips corresponds to a portion of one of several images labelled A to G. All of the image strips lie in substantially the same plane. Under each lens 4 of the lenticular array, one image slice from each of regions A to G is provided, forming a set 7 of image elements. Under the first lens, the strips in the set will each correspond to a first segment of the respective image A to G and under the next lens, the strips in the next set will each correspond to a second segment of respective images A to G and so forth. Each lens 4 is arranged to focus substantially in the plane of the image strip 6 such that, ideally, only one strip can be viewed from one viewing position through each lens 2. As such, at any viewing angle, only the strips corresponding to one of the images (A, B, C etc.) will be seen through the lenses. For example, as depicted in FIG. 2, when the device is viewed straight-on (i.e. parallel to the Z axis), each strip of image D will be viewed such that a composite image of image D is displayed (observer $O_1$). When the device is tilted about the Y axis in a first direction, only the image strips from image E will be viewed (observer $O_2$), whereas when tilted in the opposite direction, only the image strips from image C will be viewed (observer $O_3$). The lenses are capable of redirecting light from each of the image strips to the viewer, depending on the viewing angle.

The strips are arranged as slices of an image, i.e. the strips A are all slices from one image, similarly for strips B and C etc. As a result, as the device is tilted a series of different images will be seen. The images could be related or unrelated. The simplest device would have two images that would flip between each other as the device is tilted. Alternatively, the images could be a series of images that have been shifted laterally strip to strip, generating a lenticular animation effect so that the image appears to move. Similarly, the change from image to image could give rise to more complex animations (e.g. parts of the image changing in a quasi-continuous fashion), morphing (one image transforms in small steps to another image) or zooming (an image gets larger or smaller in steps).

In practice, devices such as that shown in FIGS. 1 and 2 generally do not display as sharp a transition from one image to another as might be expected. This is because at certain angles of view the portion of the image element array by each lens does not correspond to a single one of the image strips but may include a line of intersection between two of the strips, in which case the viewer will see a mixture of the two corresponding images, resulting in visual confusion and a reduction in the effectiveness of the device. This is exacerbated where the device is formed on a flexible substrate (as will typically be the case in the field of security documents) since the device may not be entirely flat when viewed, causing additional distortion to the viewing geometry.

Figure 3:
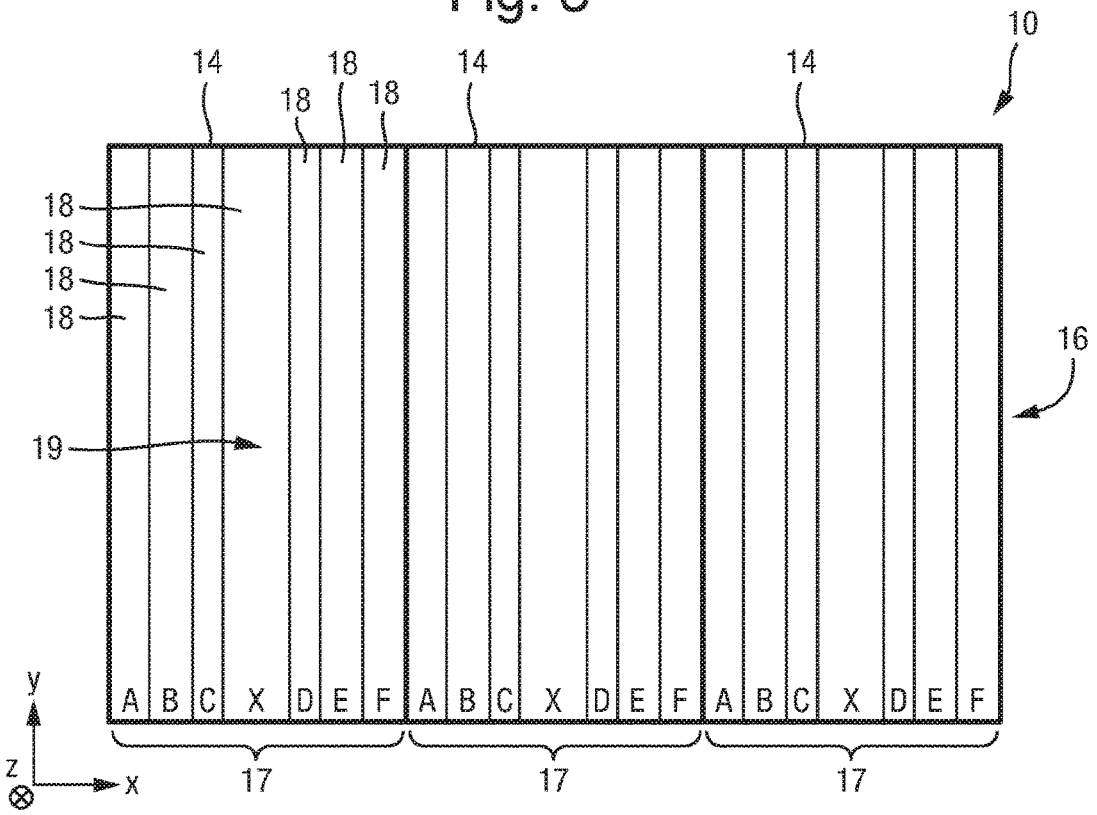
FIG. 3 is a plan view of a security device in accordance with a first embodiment of the present invention.

FIG. 3 shows a first embodiment of a security device 10 in accordance with the present invention in plan view. The physical construction of the device is the same as that depicted in FIGS. 1 and 2, with an array of cylindrical lenses 14 arranged on a transparent layer and overlapping an image element array 16. All of the image elements making up array 16 lie in substantially the same plane. The footprint of each lens 14 is denoted by thick lines and it will be seen that a corresponding set 17 of image elements 18 is provided for each lens 14. The set 17 of image elements is arranged in accordance with a unit cell configuration which is repeated across the device. Thus in this example, each unit cell 17 defines positions for seven image elements 18 (although any number of image elements could be included). As in the comparative example, here each image element 18 is an elongate image strip representing a portion of a corresponding image. Thus for example, the left-most image element position in each unit cell 17 carries in this embodiment a strip of an image "A" and the right most image element position in each unit cell 17 carries a slice of a different image "F".

Unlike the comparative example, within the unit cell 17, the image element positions 18 are not all equally sized. A centre area, which here corresponds to image element position 19, is assigned to carry an image element of a centre image "X", and this is larger than any of the areas assigned to carry the other images A, B, C, D, E and F which here correspond to the other individual image elements 18. In this example, the enlarged size of the centre image element 19 is accommodated by a corresponding reduction in the size of the adjacent image elements "C" and "D" on either side (as compared with a conventional arrangement). For instance, the centre image element position 19 may additionally take up half of the space previously allocated to each of the adjacent elements, with the result that the centre image element 19 is approximately twice as wide as each of elements "A", "B", "E" and "F", and approximately four times as wide as each of elements "C" and "D".

By arranging the proportion of the unit cell 17 which contributes to the centre image X to be greater than the proportions corresponding to each of the other images, the centre image will be displayed over a greater range of continuous viewing angles than each of the other images and thus the visual confusion exhibited by the device is reduced. Whichever portion of the image element array 16 within the centre image element position 19 is directed to the viewer by the lenses 14, the same image "X" will be displayed, meaning that at small tilt angles and, to some extent, where distortions to the viewing geometry have been caused by flexing of the device, the device will continue to display a clear, single image (image X), without interference from any of the other images A, B, C, D, E or F. Only once the device is deliberately titled to greater tilt angles will the transitions to outlying images A, B, C, D, E and F be displayed. The result is a device with a strong visual impact yet which still retains desirable optically variable effects upon tilting.

With the arrangement depicted in FIG. 3, since the image elements "C" and "D" are smaller than the other outer image elements, the respective images "C" and "D" will be displaced over correspondingly small viewing angle ranges. If preferred, the image element positions 18 outside the centre image element position 19 could alternatively all be equally sized to avoid this.

The centre image element 19 is located so as to include the centre of the unit cell 17 and most preferably is centred on the centre point of unit cell 17 as shown in FIG. 3. This is desirable so that the image displayed by the centre area 19 is visible at viewing angles along the normal to the device (i.e. the Z axis), or close to the normal, since this is the default viewing position. Most preferably, the array of focusing elements (lenses 14) is registered to the array of image elements 16 such that the centre of each focusing element substantially coincides with the centre of each unit cell in order to ensure that the image displayed by the centre area 19 is visible when the device is viewed on-axis, although this is not essential. The image displayed by the centre area 19 is therefore referred to for convenience as the "centre" image.

The images A, B, C, D, E, F and X displayed by the different areas of the unit cell 17 are all preferably different from one another so that each image element is unambiguously delimited from the next. This is not essential but if two or more adjacent image elements 18 are assigned to identical images, they in effect combine to form a single, larger element which should be considered as a whole, and thus should be smaller than centre area 19. This applies whether the two or more adjacent image elements are contained in the same unit cell 17 or in adjacent unit cells. For example if images A and F were the same as one another, the total width of elements 18 assigned to image A and F should be considered since they lie next to one another at the boundary between each unit cell and its neighbour. Further, if for instance images C and D were identical since the image elements 18 assigned to those images are not adjacent one another, the two do not combine to form a larger effective element, and each should be considered independently. The image C/D will not be continuously exhibited along the full range of viewing angles between which element C and then element D is directed to the viewer, since element X intervenes.

Figure 4:
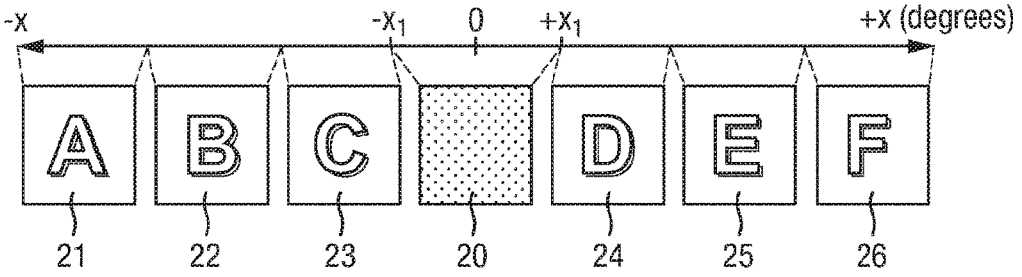
FIGS. 4 and 5 depict examples of images that may be displayed by the security device of FIG. 3 at various viewing angles.
Figure 5:
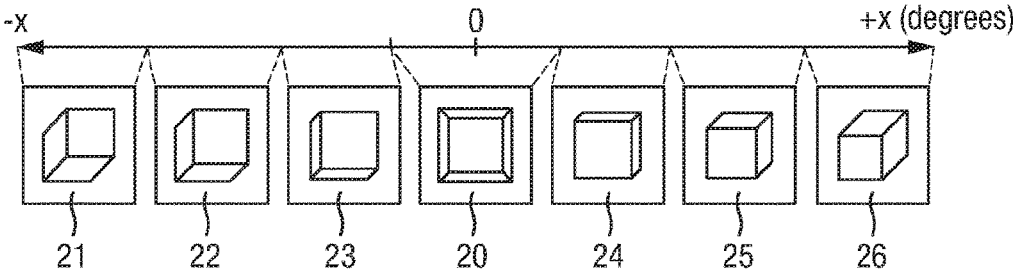

FIGS. 4 and 5 depict exemplary sets of images that may be displayed by the FIG. 3 device at different viewing angles. The line −x to +x represents the viewing angle as the device is tilted in the x direction (i.e. about the y axis). The dashed lines indicate the viewing angle at which a switch from one image to the next is perceived. In both of these examples, all seven images displayed by the device are different from one another.

In the FIG. 4 example, the centre image 20 displayed by the centre area 19 is a solid block colour (e.g. black, white, grey, red, blue, silver etc.) or, analogously, is blank all over. In either case, the centre image element 19 in each unit cell 17 will be identical across the device 10, displaying either a slice of the solid block colour or remaining empty. When the device is viewed on-axis, the device 10 will therefore appear either as a solid colour region or may be invisible. As the device is tilted in the X axis direction (about the Y axis) for small tilt angles up to $+/-x_1$ degrees, the image displayed by the device will not change since the portion of the image element array 16 within each unit cell 17 being directed to the viewer remains within the centre image element 19. Thus, for small deviations from the on-axis viewing position, as may be caused by unintended movement or flexing of the device, the device display remains static and presents a strong, clear display of the centre image without interference. As tilting in the X direction continues, the portion of the image element array 16 directed to the viewer eventually reaches the perimeter of the centre image element 19, at which point the device display transitions to image 24 (which here depicts the letter "D"), then to image 25 (which shows the letter "E") and finally to image 26 (the letter "E"). Tilting from this position in the opposite direction, the device transitions back to image 25, then image 24 before returning to the centre image 20 and then, as tilting continues, to display further images 23 (the letter "C"), then an image 22 (the letter "B") and finally image 21 (the letter "A"). As indicated in FIG. 4, the range of angles over which centre image 20 is displayed is greater than that over which any one of the other images 21 to 26 is displayed.

In preferred examples, the full range of images may be viewed over a total viewing angle range of about 30 degrees (i.e. +/−15 degrees either side of the normal). The angular range over which the centre image 20 is visible will depend on the number of different images to be viewed but will be greater than that over which any other image is visible. For example, in preferred embodiments, the centre image 20 may be displayed up to a threshold angle (at which the switch to image 23 or 24 takes place) which lies between 2 and 10 degrees from the normal, more preferably between 2.5 and 5 degrees from the normal. Thus the angular range over which the centre image is displayed may be for example between 4 and 20 degrees, more preferably between 5 and 10 degrees.

In this and all other embodiments the viewing angles over which each image carried by the device is displayed can be measured by placing the device on a table, viewing the displayed image via a camera and measuring the angle between the table and the camera. For example, the device may be mounted onto a vertical support (plane) which is mounted on a preferably circular base. This base has a position marker on it normal to the support. The base is located in or on a rotating bearing located on an underlying surface such that the upper base rotates relative to the lower surface about an axis of rotation which is vertical to the horizontal and lies in the plane of the support. Preferably the circumference of the lower base is graduated in angular units of degree. A camera can be positioned such that its optic axis lies along the normal to the support and then the upper base rotated until an image transition occurs. The corresponding angular movement is measured off the lower surface, and so on.

By forming the centre image 20 as a solid block colour or blank void, a further degree of visual separation is introduced between images 22 and 23, since these will no longer transition directly from one to the other. Rather, as the device is tilted, e.g. from image 22 to image 23, the displayed letter "B" will disappear and a blank/solid colour background be shown before the image of the letter "C" becomes visible. This avoids any visual overlapping of the two images and therefore further reduces visual confusion.

FIG. 5 shows a further example of images which may be displayed by the FIG. 3 device and here the images are different views of a 3-Dimensional object. The centre image 20, displayed when the device is viewed on-axis, is a front view of an object (here, a cuboid) and will remain static as the device is moved through small tilt angles due to the above-described enlarged centre image element 19 within each unit cell. When the device is tilted in the X direction, at higher tilt angles a transition to image 24 is seen whereby the same object now appears in perspective view, and then images 25 and 26 are displayed sequentially in each of which the object appears to have been further rotated. Likewise, if the device is tilted in the opposite direction, different views of the same object from the opposite side are displayed (images 21, 22 and 23). Again, the provision of a relatively large centre image element 19 (compared to outer image elements) assigned to the centre image 20 provides a clear and stable appearance when the device is viewed on or close to on-axis, whilst the optically variable effect is retained at higher tilt angles.

In the devices depicted so far, the above-described optically variable effect will only be observed when the device is tilted about the Y axis (i.e. these are "one-dimensional" lenticular devices). Tilting the device about the X axis will produce no observable change since the cylindrical lenses focus light in one direction only (parallel to the X direction). In contrast, FIG. 6 shows a security device in accordance with further embodiments of the present invention which is capable of generating optically variable effects in two dimensions, i.e. as the device is tilted in either of at least two orthogonal axes, preferably the X and Y axes. In practice, depending on the arrangement of underlying image elements, the present example may be capable of generating such effects when the device is tilted about any direction lying in the X-Y plane, but this is not essential. Here, the security device 10 comprises an array of focusing elements 14 which take the form of (hemi-)spherical lenses arranged in a regular orthogonal grid pattern, although in other embodiments the focusing elements 14 could be mirrors. The focusing elements could also have aspherical focusing surfaces if preferred. Thus, each focusing element 14 is capable of focusing light in at least two orthogonal directions, e.g. parallel to the X axis and parallel to the Y axis. (Indeed spherical and aspherical lenses can focus light in all directions). The underlying array of image elements 16 on the opposite side of transparent substrate 12 will be described in more detail below (and is shown only schematically in FIGS. 6 and 7), but comprises image elements arranged in an array which is periodic in both the X and Y directions, using for example the same principles of interweaving elements from multiple images as described in U.S. Pat. No. 6,483,644. The periodicity and orientation of the image element array is substantially the same as that of the focusing element array 14, and as such in the present case is also based on an orthogonal grid.

FIG. 7*a* depicts a cross-section through part of the device 10 along the X axis and it will be seen that this is comparable to FIG. 2 as discussed above, with the observer $O_1$ (viewing the device from a first off-axis position) having light from image elements A directed to him by the lenses 14. FIG. 7*b* shows a cross-section through another portion of the device 10 along the Y axis and, unlike the device of FIG. 1, here the cross-section is substantially the same as along the X axis. Since the lenses 14 are additionally capable of focusing light in this direction, here, an optically variable effect will additionally be viewed when the device is tilted about the X axis, such that the observer $O_2$ viewing the device from a second, different off-axis position will now perceive the image elements B such that a different image, B, is viewed. Thus, the device depicted in FIGS. 3 and 4 is capable of displaying transitions between different images both as the device is tilted about the X axis and as the device is tilted about the Y axis.

FIG. 8 shows an arrangement of image elements and their positions relative to a lens array according in accordance with a second embodiment of the present invention, which can be used in a device of the type shown in FIG. 6. In this case, the lens array 14 is an orthogonal grid of lenses, each of which has a substantially square footprint 14*a*. An array of five lenses (in the X axis direction) by three lenses (in the Y axis direction) is depicted. The image element array 16 is based on a repeating unit cell 17 which is of substantially the same shape and size as the lens footprint 14*a*, i.e. substantially square in this example. Again, an array of five unit cells (in the X axis direction) by three unit cells (in the Y axis direction) is depicted.

Defined within the unit cell 17 are a number of image element position 18 (or "sectors"). In this example, there are 25 image element positions 18 in each cell 17, arranged in a 5 by 5 array of which the centremost image element position 19 is enlarged relative to the outer positions. As before, it is preferable that the subset 19 is centred on the centre point of the unit cell 17, as is the case in FIG. 8, but this is not essential provided it includes the centre point. In this case, each image element position 18, 19 is assigned an image element belonging to a corresponding image. That is, the centre image element position 19 constitutes the centre area assigned to the centre image, and each individual element 18 outside the centre area constitutes an outer area assigned to a respective outer image. More generally, such outer areas carrying elements of images different from the centre image should exist outside the subset 19 in at least one direction but, in preferred examples such as that shown in FIG. 8, such outer areas are provided on either side of the centre image element 19 in both orthogonal directions (e.g. along the X axis and Y axis).

In the present example, each of the image element positions 18 outside the subset 19 carries a different image element, corresponding to different respective images (and therefore in this case, each image element position constitutes a different "outer area"). For example, along the X axis, the image element positions 18 outside the subset 19 carry elements of images A, B, C and D respectively, and along the Y axis there are outer image elements corresponding to images E, F, G and H. It should be noted that whilst the corner image element positions are not labelled in FIG. 8, typically these will also carry elements of yet further images. Similarly, for clarity it will be understood that the contents of only one unit cell 17 has been labelled in FIG. 8 and of course this would be repeated across the device.

As in the FIG. 3 embodiment, in the present example, the increased size of image element 19 is accommodated by a reduction in size of the immediately adjacent image elements 18, although in other cases the outer elements can all be of the same size as previously mentioned. In this example, the centre image element is approximately 4 times the size (in terms of area), and twice the side-to-side dimensions (in both the x and y directions) of the outermost image elements at the periphery of the unit cell 17.

FIG. 8 also schematically depicts the locations of four observers $O_a$, $O_b$, $O_c$, and $O_d$ at various off-axis locations. FIG. 9 shows exemplary images which may be displayed by a device of the sort shown in FIG. 8 from these and other viewing positions, although in this case certain of the images allocated to selected image elements are the same as one another as discussed further below. When the device is viewed on-axis, a centre image 20 is displayed and, in this example the image depicts a sun-shaped symbol. When the device is tilted in any direction by only a small angle, or is distorted, the displayed image will remain static since the portion of the image element array 16 which is directed to the viewer remains inside image element position 19. This ensures the visual stability of the device as previously described.

When the device is tilted along the X axis direction (about the Y axis) towards the position of observer $O_a$, the image element positions labelled C and then D in each unit cell are sequentially directed to the viewer and thus the images 23 and then 24 are displayed by the device as a whole, which show the same sun-shaped symbol but at a reduced size. When the device is titled in the opposite direction to the position of observer $O_b$, the image elements labelled B and then A are displayed and the result is sequential observation of images 22 and then 21, which again show the same sun shaped symbol at reduced size. Thus, as the device is titled between the positions of observers $O_a$ and $O_b$ along the X axis, the device appears to display a sun shaped symbol which increases and decrease in size (an example of a "zooming" effect). It will be noted that images 21 and 24 are the same as one another, as are images 22 and 23. Since the image elements B and C exhibiting image 22/23 are separated from one another, even once the tiling of the unit cell is taken into account, they do not combine to form a continuous viewing region and hence should be considered individually. However, since the elements A and D exhibiting image 21/24 are located at the edge of the unit cell, they lie adjacent elements of the same image in the next unit cell (see for instance element D'). As such, the two elements (A and D) do effectively combine to form a continuous viewing region (even though they are not next to one another in the unit cell itself) and their total area should be less than that of the centre area 19 in order that the centre image 20, displaying the largest image of the sun symbol, will be displayed over the largest continuous viewing angle range. When the device is tilted in the opposite direction along the Y axis (i.e. about the X axis) to the position of observer $O_c$, image elements F and then E are displayed which correspond to images 26 and 27 which show stages in a "morphing" sequence in which the sun-shaped symbol is replaced by a moon symbol (image 25). In the opposite direction, image elements G and then H are displayed, corresponding to images 27 and 28 in which the sun-shaped symbol morphs into a star symbol. Again, the sun-shaped symbol 20 is displayed over a greater range of angles than images 25, 26, 27 or 28. In this case, since images 25 to 28 are all different, none of the respective image elements E, F, G and H combine with one another and they can be considered individually. Preferred ranges of viewing angles over which the centre image 20 is displayed are the same as discussed in relation to FIG. 4, applying in both the x and y directions.

The images displayed by other image elements (such as image 29) are not depicted in FIG. 9 but could comprise for example reduced sizes of the relevant symbol in the morphing sequence, e.g. image 29 could be of a circle symbol matching that in image 26 but of a reduced size. This would maintain the impression of a zooming effect activated by x-axis tilt in combination with a morphing effect activated by y-axis tilt.

FIG. 10 shows an example of an alternative unit cell 17 which again is based on a 5×5 array of image element positions 18 with an enlarged centre image element position 19 corresponding to the centre image. Outside the centre area 19, the unit cell is divided into eight outer areas 30, 31, 32, 33, 34, 35, 36 and 37, each of which comprises a plurality of image element positions 18. Within each area, each of the image element positions is assigned image elements from the same image. Thus, image elements in area 30 may carry portions of an image "A", those in area 31 portions of an image "B" and so on. However, in order to maintain the improved visual stability as previously described, the centre area 19 should be larger than any of the outer areas 30, 31 etc.

FIG. 11 shows another unit cell 17 which can be used in further embodiments. In this example the unit cell is hexagonal rather than square or rectangular and again includes an enlarged centre image element 19. In this example, each of the image element positions 18 outside the centre image element 19 corresponds to a different respective image. It will be noted that in this example all of the outer image element positions 18 are of equal size.

In the examples so far, the centre image element 19 is enlarged relative to other image element positions 18 to the extent that its area is greater than that of any other image element position in the unit cell. This is preferred but not essential (at least in a two-dimensional device) provided that the side-to-side dimension of the centre image element 19 along the first or second direction (e.g. x or y axis) is greater than the corresponding dimension of any of the outer image element positions, since this will achieve visual stabilisation when the device is tilted in that direction. Preferably this criterion applies in both the first and second directions so that stabilisation is achieved whichever direction the device is tilted in. Any relative enlargement in this way will achieve a corresponding improvement in image stability. However in preferred cases the centre image element will be at least 10% larger and more preferably at least 25% larger than any of the outer image element positions 18, referring to the relevant side-to-side dimensions of the image element positions (e.g. edge length of a square/rectangular image element position, or diameter of a circular image element position), in at least the first and preferably also the second directions. Where the outer image element positions are of various sizes, this may be relative to the average size of the outer image element positions.

In the embodiments so far, the centre area of the unit cell assigned to carry the centre image comprises a single image element position 19. However a similar improvement in visual stability can also be achieved by forming the central area in an alternative manner as will now be described with respect to third and fourth embodiments of the invention.

FIG. 12 shows a third embodiment of a security device 100 in accordance with the present invention in plan view. The physical construction of the device is the same as that depicted in FIGS. 1 and 2, with an array of cylindrical lenses 140 arranged on a transparent layer and overlapping an image element array 160. The footprint of each lens 140 is denoted by thick lines and it will be seen that a corresponding set 170 of image elements 180 is provided for each lens 140. The set 170 of image elements is arranged in accordance with a unit cell configuration which is repeated across the device. Thus in this example, each unit cell 170 defines positions for seven image elements 18 (although any number of image elements could be included). As in the first embodiment, here each image element 180 is an elongate image strip representing a portion of a corresponding image. Thus for example, the left-most image element position in each unit cell 170 carries in this embodiment a strip of an image "A" and the right most image element position in each unit cell 170 carries a slice of a different image "D".

Within the unit cell 170, a subset 190 of image element positions 180 is defined (outlined using dotted lines in FIG. 12), which constitutes the central area of the unit cell and is assigned to carry the centre image. The subset 190 comprises a plurality of the image element positions 180 (here, three) which are each assigned to carry copies of the same image element from the centre image "X". The remaining image element positions 180 outside the subset 190 are assigned to carry image elements of different respective images A, B, C and D in much the same manner as described above.

By assigning a plurality of adjacent image element positions 180 to carry the same image element from a corresponding image (the subset 190), a centre area of increased size relative to areas of the unit cell assigned to other images is once again formed and leads to a reduction in the visual confusion exhibited by the device. Whichever portion of the image element array 160 within subset 190 is directed to the viewer by the lenses 140, the same image "X" will be displayed, meaning that at small tilt angles and, to some extent, where distortions to the viewing geometry have been caused by flexing of the device, the device will continue to display a clear, single image (image X), without interference from any of the other images A, B, C or D. Only once the device is deliberately titled to greater tilt angles will the transitions to outlying images A, B, C and D be displayed. The result is a device with a strong visual impact yet which still retains desirable optically variable effects upon tilting.

As before, the subset 190 is located so as to include the centre of the unit cell 170 and most preferably is centred on the centre point of unit cell 170 as shown in FIG. 12. This is desirable so that the image displayed by the subset 190 is visible at viewing angles along the normal to the device (i.e. the Z axis), or close to the normal, since this is the default viewing position. Most preferably, the array of focusing elements (lenses 140) is registered to the array of image elements 160 such that the centre of each focusing element substantially coincides with the centre of each unit cell in order to ensure that the image displayed by the subset 190 is visible when the device is viewed on-axis, although this is not essential. The image displayed by the subset 190 is therefore referred to for convenience as the "centre" image.

FIGS. 13 and 14 depict exemplary sets of images that may be displayed by the FIG. 12 device at different viewing angles. In the FIG. 13 example, the centre image 200 displayed by the subset 190 is a solid block colour (e.g. black, white, grey, red, blue, silver etc.) or, analogously, is blank all over. In either case, the image elements 180 within the subset 190 in each unit cell 170 will be identical across the device 100, displaying either a slice of the solid block colour or remaining empty. When the device is viewed on-axis, the device 100 will therefore appear either as a solid colour region or may be invisible. As the device is tilted in the X axis direction (about the Y axis) for small tilt angles, the image displayed by the device will not change since the portion of the image element array 160 within each unit cell 170 being directed to the viewer remains within the subset 190 in which the same image 200 is displayed by all of the image elements. Thus, for small deviations from the on-axis viewing position, as may be caused by unintended movement or flexing of the device, the device display remains static and presents a strong, clear display of the centre image without interference. As tilting in the X direction continues, the portion of the image element array 160 directed to the viewer eventually reaches the perimeter of the subset 190, at which point the device display transitions to image 230 (which here depicts the letter "C"), and then to image 240 (which shows the letter "D"). Tilting from this position in the opposite direction, the device transitions back to image 230 before returning to the centre image 200 and then, as tilting continues, to display a further image 220 (the letter "B") and then an image 210 (the letter "A"). Preferred viewing angle ranges over which the centre image 200 is visible are the same as discussed in relation to FIG. 4.

By forming the centre image 200 as a solid block colour or blank void, a further degree of visual separation is introduced between images 220 and 230, since these will no longer transition directly from one to the other. Rather, as the device is tilted, e.g. from image 220 to image 230, the displayed letter "B" will disappear and a blank/solid colour background be shown before the image of the letter "C" becomes visible. This avoids any visual overlapping of the two images and therefore further reduces visual confusion.

FIG. 14 shows a further example of images which may be displayed by the FIG. 12 device and here the images are different views of a 3-Dimensional object. The centre image 200, displayed when the device is viewed on-axis, is a front view of an object (here, a cuboid) and will remain static as the device is moved through small tilt angles due to the above-described subset 190 of identical image elements within each unit cell. When the device is tilted in the X direction, at higher tilt angles a transition to image 230 is seen whereby the same object now appears in perspective view, and then image 24 is displayed in which the object appears to have been further rotated. Likewise, if the device is tilted in the opposite direction, different views of the same object from the opposite side are displayed (images 210 and 220). Again, the provision of multiple copies of the same image element within each unit cell to form subset 190 provides a clear and stable appearance when the device is viewed on or close to on-axis, whilst the optically variable effect is retained at higher tilt angles.

The FIG. 12 embodiment is a one-dimensional device akin to that of FIG. 3. FIG. 15 depicts a fourth embodiment of the invention in which the same principles are applied to a two-dimensional device.

Thus, FIG. 15 shows an arrangement of image elements and their positions relative to a lens array according in accordance with an embodiment of the present invention, which can be used in a device of the type shown in FIG. 6. In this case, the lens array 140 is an orthogonal grid of lenses, each of which has a substantially square footprint 140*a*. An array of five lenses (in the X axis direction) by three lenses (in the Y axis direction) is depicted. The image element array 160 is based on a repeating unit cell 170 which is of substantially the same shape and size as the lens footprint 140*a*, i.e. substantially square in this example. Again, an array of five unit cells (in the X axis direction) by three unit cells (in the Y axis direction) is depicted.

Defined within the unit cell 170 are a number of image element position 180 (or "sectors"). In this example, there are 25 image element positions 180 in each cell 17, arranged in a 5 by 5 array. Each image element position 180 is assigned an image element belonging to a corresponding image and, as in the previous embodiment, a central subset 190 of the image elements 18 is defined such that all of the image element positions 180 within the subset 190 carry the same image element of a common "central" image X, thereby forming a centre area which is larger than the area assigned to any one of the other images carried by the device. As before, it is preferable that the subset 190 is centred on the centre point of the unit cell 170, as is the case in FIG. 15, but this is not essential. In at least one direction, additional image element positions 180 carrying elements of images different from the centre image exist outside the subset 190 and, in preferred examples such as that shown in FIG. 15, such image element positions are provided on either side of the subset 190 in both orthogonal directions (e.g. along the X axis and Y axis). The image element positions 180 existing outside the subset 190 may each be assigned to carry image elements of different respective images (i.e. each one constituting a "outer area" of the unit cell) or, as discussed below, some further groups of image elements carrying elements of the same image (still different from the central image) may be formed, in which case each group forms an "outer area". In this case the number of image element positions assigned to the central subset 190 will be greater than the number included in any one other such group. It should be noted that this principle applies equally to one-dimensional devices.

In the present example, each of the image element positions 180 outside the subset 190 carries a different image element, corresponding to different respective images. For example, along the X axis, the two image element positions 180 outside the subset 190 carry elements of images A and B respectively, whereas above and below these image element positions, elements of different images A', A", B' and B" are provided. These may for example show further views of a 3-Dimensional object from suitably displaced viewing angles. Similarly, along the Y axis, elements of two images C and D are provided outside the subset 190 and on either side of these image element positions, additional images C', C", D' and D" are provided. It should be noted that whilst the corner image element positions are not labelled in FIG. 15, typically these will also carry elements of yet further images. Similarly, for clarity it will be understood that the contents of only one unit cell 170 has been labelled in FIG. 15 and of course this would be repeated across the device.

FIG. 15 also schematically depicts the locations of four observers $O_a$, $O_b$, $O_c$, and $O_d$ at various off-axis locations. FIG. 16 shows exemplary images which may be displayed by a device of the sort shown in FIG. 15 from these viewing positions. When the device is viewed on-axis, a centre image 200 is displayed and, in this example (as in the case of the FIG. 4 embodiment), the image is a solid block colour or blank region with no indicia. When the device is tilted in any direction by only a small angle, the displayed image will remain static since the portion of the image element array 160 which is directed to the viewer remains inside subset 190 where each image element position 180 carries the same image element in each unit cell 170.

When the device is tilted along the X axis direction (about the Y axis) to the position of observer $O_a$, the image element position labelled A in each unit cell is directed to the viewer and together these form the image 210 which in this example is a representation of the letter "A". When the device is titled in the opposite direction to the position of observer $O_b$, the image element labelled B is displayed and the result is observation of image 220, which here is a representation of the letter "B". As the device is titled between these two images along the X axis, the centre image 200 is displayed between display of the letter A and of the letter B such that there is no overlap between them. When the device is tilted in the opposite direction along the Y axis (i.e. about the X axis) further images 230 and 240, depicting the letters C and D respectively, are visible at higher tilt angles. Preferred viewing angle ranges over which the centre image 200 is displayed are the same as described in relation to FIG. 4.

As mentioned above, in this example each image element position outside the subset 190 is assigned to carry a portion of a different respective image, but this is not essential. For example, the three image element positions labelled A, A' and A" could form a group (or "outer area") in which each position carries an element of the same image A and likewise those labelled B, B' and B" could form a second group, each carrying images of the same image B, etc.

In embodiments where the centre area comprises a single, enlarged image element position 19 (such as those of FIGS. 3 and 8), the image element array can be formed by dividing the centre image 20 into larger image elements than those of any of the other images, and assigning the selected elements to the central image element positions using the techniques disclosed for example in U.S. Pat. No. 6,483,644.

To form the centre area as a subset 190 of multiple image element positions, as in the FIGS. 12 and 15 embodiments, a modified technique is required as illustrated in FIG. 17. This shows in more detail the relationship between the centre image 200 displayed by the device as a whole when the device is viewed from the corresponding viewing position, and the image elements making up the array 160. Again, in this example each unit cell 170 defines a set of 25 image element positions 180. As previously described, within each unit cell 170 of the image element array 160, a predefined subset 190 of the image element positions 180 will each be assigned to carrying the same portion ("image element") of a corresponding centre image, whilst other predefined positions outside the subset will be available for carrying portions of other respective images. Thus, in the arrangement shown in FIG. 17, the device is configured to display up to 17 different images as the device is tilted: the centre image (conveyed by the image element positions within the subset 190) and up to 16 other images carried by the image element positions outside the subset (if each image element position is assigned to a different image).

In examples such as those shown in FIG. 4 and FIG. 16, the centre image 200 is a solid block colour or is blank, in which case all of the image element positions within the subset 190 of every unit cell 170 across the device will carry identical image elements (of the appropriate colour or left empty). Where the centre image is not a solid colour but includes indicia or a pattern, the distribution of image elements is more complex but the same principles apply. FIG. 17*a* shows an example of a centre image 200 which, in this example, is an image of a "sun" symbol and is monochromatic (although this is not essential). In this example, the rectangle surrounding the sun image defines the extent of the security device (i.e. the extent of the focusing element array and/or the image element array) and the image is sized as appropriate for viewing without magnification by the user. FIG. 17*b* shows an enlarged detail of the image 200 and illustrates its division into cells 170 (here arranged on a regular orthogonal grid, although this is not essential). The periodicity of this cellular division is selected to correspond to that of the focusing element array 140 which is to be overlapped with the image element array, i.e. ultimately one focusing element will be aligned with each of the cells 170. Within each unit cell 170, the image 200 is further divided into image elements (not visible in FIG. 17(*b*). The image elements could be individual pixels of the image or could be larger, e.g. groups of pixels. In this example, for the sake of illustration, the image elements will be depicted as being larger than individual pixels, such that each image element can contain areas of different appearance (e.g. colour or grey value). However, this will generally only be suitable where the device dimensions are relatively large and so, more typically, each image element will correspond to a single pixel and will therefore convey a single value across its area (e.g. all black or all white).

As the centre image of the device, image 200 is to be conveyed by the image element positions 180 within the subset 190 defined by each unit cell across the image element array 160. This is achieved by selecting an image element from each unit cell division of the image 200 and applying copies of the selected image element to each image element position within the sub-set 190 in the corresponding unit cell of the image element array 160. Thus, in this example, in the left-most column 300 of the array section displayed in FIG. 17*c*, each image element position inside the subset 190 is completely filled in, representing the interior of the circle shape forming the centre of the sun symbol, and the same is the case in second column 310. In column 320, the image element positions inside the subsets 190 are taken from the edge of the circular region of the sun symbol, such that each one is partially filled-in and partially blank, the blank proportion increasing towards the bottom of the depicted array section. It should be noted that whilst within each individual unit cell 170 all the image elements in the subset 190 will be identical, they will vary between unit cells if the central image is to display indicia or a pattern, as illustrated in column 320.

The image element positions in the subsets 190 in column 330 are left blank since these fall in-between the central circular portion of the sun symbol and the right-most triangular "sunray" shape; and the subsets 190 in right-hand columns 340 and 350 depict the beginnings of that triangular "sunray" shape. This is continued across the whole device such that, whichever image element 180 from the subset 190 is selected for viewing by the focusing array (depending on the viewing angle), the resulting array of selected image element positions across the device conveys the complete image 200. Hence, when the device is viewed from the on-axis position or close to it, the array of lenses 140 direct only the image elements located from inside the subsets 190 to the viewer, whilst all surrounding image elements remain obscured such that only the desired centre image 200 is displayed.

The other images, to be exhibited at different viewing angles, are input into the image element array 160 using the same technique except that typically only a single image element position 180 in each unit cell will be allocated for display of each of the other images. For example, image elements making up an image A, to be displayed to the observer $O_a$ shown in FIG. 15, will be inserted into the image element position in the right-most column, third row of each unit cell, and so on. As such it should be appreciated that whilst the image element array shown in FIG. 17*c* only shows image elements present in the central subset 190 of each unit cell 170, in practice image elements corresponding to the other images will also be provided in the surrounding image element positions (unless the relevant images are blank in the region depicted).

It will be appreciated that forming the centre area as a subset 190 of multiple image element positions (as in the FIGS. 12 and 15 embodiments) reduces the number of other image element positions available for display of other images. For instance, as seen in the FIG. 15 example, if the unit cell comprises a 5×5 array of image element positions 18, assigning the central 3×3 positions to subject 19 leaves only one image element position 18 outside the subset on each side. As such, where the total number of available image element positions is limited, e.g. as a result of the need to use relatively low resolution techniques for forming the image elements, it is preferred to form the centre area as a single enlarged image element 19 as in the preceding embodiments. However, where high-resolution imaging techniques are available, multiple image elements can be assigned to a subset 190 whist leaving sufficient other image element positions for other images.

Thus, FIGS. 18, 19 and 20 show three examples of alternative unit cells for 2-Dimensional devices based on the principles of the FIG. 15 embodiment. In FIG. 18, the unit cell 170 is again square and here comprises an array of 10 by 10 image element positions 180. In practice, any number of image element positions could be defined within the unit cell, such as an array of M×N image element positions, where M and N are each integer numbers of at least two for a 2-Dimensional device. Within the unit cell, a subset 190 is defined (outlined by dotted lines) within which all of the image element positions carry the same image element of a common centre image "X", as previously described. In 2-Dimensional devices, the subset 190 is preferably a 2-Dimensional array of image element positions, including multiple image element positions in each orthogonal direction, such as the example depicted here. However this is not essential since in some cases it may be desirable to provide such a subset which extends in one direction only, introducing the above-described improvement in image stability when the device is tilted in one axis but not in the other. Nonetheless, symmetrical devices such as that shown in FIG. 18 are generally preferred.

The image elements can be allocated from the various images which the device is configured to display by interweaving the image elements from each image using for example the technique disclosed in U.S. Pat. No. 6,483,644. This applies to all of the image element positions 180 except those forming part of the subset 190 which will each carry a copy of the same image element as discussed with respect to FIG. 17.

As mentioned previously, outside subset 190 each of the image element positions 180 may be assigned to a different image, or multiple positions could be assigned to the same image (forming groups) depending on the desired effects. For example, in the FIG. 11 embodiment, the centre subset 190 is substantially diagonal in shape and the image element positions 180 along each one of the four edges are assigned to the same image. For instance, the image element positions labelled $A_1$ are all assigned to one image, those labelled $B_1$ to another and those labelled $B_2$ to a third. In this example, this arrangement could be used for instance to depict a 3-Dimensional object where the centre image conveyed by the subset 190 presents a front view and the four quadrants A, B etc outside the subset 190 display four different sides of the same object at increasing angles of view $A_1$, $A_2$ etc towards the four corners of the unit cell 170.

It is also preferred that the number of image element positions 180 outside the subset 190 is substantially equal on each side of the subset 190, as exemplified by the FIG. 18 embodiment. This makes it possible to convey the same number of different images on each side improving the symmetry of the device.

Square or rectangular unit cells such as those depicted so far are particularly suited to focusing element arrays arranged on a orthogonal grid. However, alternative unit cell arrangements can also be utilised, such as hexagonal unit cells of which an example is shown in FIG. 19. Again, the image element positions 180 are assigned to carry image elements of respective images in accordance with the teaching in U.S. Pat. No. 6,483,644 for example, except within a centre subset 190 (depicted using dotted lines) within which all of the image element positions carry copies of the same image element from the common centre image. As in other preferred examples, here the subset 190 is centred on the centre of the unit cell C. The proportion of the unit cell 170 taken up by the subset 190 is selected according to the desired optical effect. The greater the proportion of the unit cell occupied by the subset 190, the more stable the centre image displayed by the device will appear since it will continue to be exhibited at relatively large tilt angles. However, this reduces the space available to display other images which reduces the optically variable nature of the device and, as such, a balance must be found between the two objectives. In the present example, the subset 19 occupies nearly 25% of the unit cell area (40 out of 164 image element positions), but in other examples the proportion will typically be less. Generally, it is preferred that the size of the unit cell region assigned to the central image (i.e. the subset 190 in the present case) will be at least 10% greater and more preferably at least 25% greater than that assigned to any one of the other images (i.e. to each "outer area", which may comprise a single image element position or a group of such positions, depending on the configuration). Here, the "size" refers to the side-to-side dimensions of the respective areas and as previously mentioned whilst it is preferred that the centre area has larger dimensions than each of the outer areas in both the first and second directions, this is not essential. It is also preferred that the centre area is greater in terms of area than the outer areas but again this is not essential (at least in two-dimensional devices).

In the FIG. 20 embodiment, the unit cell 170 is again square, here comprising an array of 11 by 11 image element positions 180, and the subset 190 comprises a 3 by 3 array of the image element positions 180 located at the centre of the unit cell 170. Of course the subset 190 could comprise any array of m×n image element positions, provided m and n are smaller than the size of the unit cell, M×N. The image element positions located immediately outside the subset 190 (those between the dotted lines defining subset 190 and the dashed lines indicated) are assigned to carry intermediate images which depict intermediate stages between the content of the centre image and those carried by image element positions located towards the perimeter of the unit cell. For example, the image element position $A_{18}$ in this example corresponds to an image which is an intermediate step between that depicted by the central subset 19 and that represented by outer image element position $A_{13}$, and so on. An intermediate image may for example be a frame in an animation, motion, morphing or zooming sequence.

Hence, the various techniques described above result in a device which displays a centre image (carried by a centre area of each unit cell in the form of either an enlarged image element position 19 or a subset 190) over a greater range of continuous viewing angles than each other image, which improves the visual stability of the device. FIG. 21 schematically depicts a two-dimensional security device formed on these principles in perspective view. The image element array may be configured based on unit cells such as that shown in FIG. 8 or 15, for example. The locations of five observers, $O_1$, $O_a$, $O_b$, $O_c$ and $O_d$, are illustrated. Observer $O_1$ views the device on-axis (along the device normal), whilst observers $O_a$, $O_b$, $O_c$ and $O_d$ view the device from different off-axis positions. To change the viewing position of observer $O_a$ to that of observer $O_c$, the device is tilted about line P-P', which is the diagonal bisecting the positive X and Y axes, and to transition from the position of observer $O_b$ to that of observer $O_d$, the device is tilted about the line Q-Q', which is the diagonal bisecting the negative X axis and the positive Y axis.

The images displayed to each observer can be selected as appropriate for the desired visual effect and input into the image element array using the techniques described above. Some further examples of suitable images will now be described with respect to FIGS. 22, 23 and 24.

In the FIG. 22 embodiment, the central image 20 is a sun-shaped symbol which is carried by the centre area and hence is visible when the device is viewed on-axis by observer $O_1$ shown in FIG. 21, as well as at small deviations from that axis. Second image 21 is a star-shaped symbol, which is visible from the position of observer $O_a$. This is achieved by using one or more image element positions in the top left section of the unit cell to convey the star symbol 21. From the position of observer $O_c$, a third image 23 is visible which here represents a thunderbolt symbol, which is conveyed by one or more image element positions in the bottom right section of the unit cell 17 (e.g. image element positions $B_1$, $B_2$ etc in FIG. 18). Thus, as the device is tilted about the line P-P' from the position of observer $O_a$, through the on-axis observation position $O_1$ and on to the position of observer $O_c$, the device appears to display in sequence, star shaped symbol image 21, followed by sun shaped symbol image 20 and finally thunderbolt shaped symbol image 23. Similarly, if the device is tilted in the reverse direction, the same images will be displayed in reverse order. The sun shaped symbol image 20 will be displayed over a greater range of viewing angles than any of the other images.

From the position of observer $O_b$, a fourth image 22, here in the form of a moon-shaped symbol, will be visible whilst from the position of observer $O_d$, a fifth image, here in the form of a cloud-shaped symbol 24, will be displayed. Thus as the device is tilted about the line Q-Q' from the position of observer $O_b$, through the on-axis observation position $O_1$ to the position of observer $O_d$, the device will display the moon-shaped symbol image 22 followed by the sun-shaped image 20 and finally the cloud-shaped image 24. Again, if the device is tilted in the reverse direction, the same images will be displayed in reverse order.

It will be appreciated that FIG. 22 only shows the images displayed when the device is tilted along the x and y axes, and different images may be exhibited when the device is tilted in different directions, depending on the images carried by the various image element positions. For example, image element positions located between that carrying the star shaped image 21 and that carrying the moon shaped image 22 could be assigned to carry elements of images showing steps in an animation sequence in which one shape morphs into the other.

In the FIG. 22 example, the images are not related to one another other than sharing a conceptual similarity (celestial objects). However, in preferred examples the images displayed by the device at different viewing angles may be related to one another in order to produce certain visual effects.

For example, as shown in FIG. 23 the different images could be views of the same object from different viewpoints, in a manner comparable to the one-dimensional device illustrated in FIG. 5. As a simple example, in FIG. 23 the five images depicted are each views of a cuboid from different angles. The central image 20 is a front view of the cuboid in which only the face of the cube nearest the viewer is visible. The four views 21, 22, 23 and 24 are respective views of the cuboid from different angles. The result is that, as the device is tilted, the different views of the object are presented to the user, giving the overall impression of viewing a three-dimensional object. Again, since the centre image 20 is carried by the centre area and thus a larger proportion of the area within each unit cell than any other image, it is displayed to the on-axis viewer and at small tilt angles, resulting in a clear and stable appearance until the device is deliberately tilted further.

In other examples, the images could be configured to exhibit motion, animation, morphing or zooming effects as previously mentioned in connection with FIGS. 1 and 2.

FIG. 24 shows a further example of suitable images which could be displayed by the device at certain viewing positions. Here, all the images displayed by the device are of a four-headed arrow symbol, which is defined by an outline 39 that is common to all images. The interior of the arrow region is different in each of the five images. In the centre image 20, visible when the device is viewed on-axis, all four quarters of the arrow are shaded-in, e.g. with a different colour in each arrowhead. In the second image 21, visible to observer $O_a$, only the bottom right arrowhead is filled-in, and the other three are blank. In the third image 22, only the bottom left arrowhead is shaded, whilst in the fourth image 23 only the top left arrowhead is shaded and in the fifth image 24 only the top right arrowhead is shaded. Thus, when the device is viewed off-axis, the shaded arrow will appear to change orientation and colour as the device is tilted.

The outline 39 is a common component of all images and therefore acts as a "keyline" which remains constant as the device is tilted. This assists the user in identifying the position of the optically variable effect and also enhances the apparent change from one tilt position to another, since the different images can be more readily compared to one another. In other examples, keylines such as this could be provided by a frame surrounding each image, such as the rectangles shown surrounding the sun, star, moon, thunderbolt and cloud images in FIG. 22. Alternatively an internal line, portion or section of an image could act as a keyline in this way—for instance, the centre square formed at the intersection of the four arrows in each of the images in FIG. 24.

As previously mentioned, in preferred examples the individual focusing elements may have spherical or aspherical focusing surfaces. However, this does not require the footprint of each focusing element to be circular, as illustrated in FIG. 25. FIG. 25*a* shows, for the sake of illustration, a spherical surface S and a three-dimensional segment of that surface labelled 14*a*. This is shown in isolation in FIG. 25*b* where it will be seen that the portion of the spherical surface forms the focusing surface fs of the lens element 14*a* whilst the underlying footprint fp can be square or rectangular, according to the dimensions of the segment. Forming the focusing elements in this way enables the array to be closely packed, without significant gaps between each focusing element, on an orthogonal grid.

However, in other cases focusing elements having circular (or oval) footprints may be used and an example of such an embodiment is shown in FIG. 26. Here, the individual focusing elements 14 are hemispherical. Such elements could be arranged on an orthogonal grid as shown in FIG. 6 but due to the gaps this will leave between elements, it may be preferred to arrange such elements in a hexagonal close packed grid as shown in FIG. 26. In this case, the corresponding unit cell 17, 170 will be a regular hexagon. Here, the unit cell does not exactly match the shape of the lens footprint. Exemplary unit cell arrangements for the image element positions in a hexagonal unit cell were shown in FIGS. 11 and 19.

In all embodiments, the focal length of each focussing element should preferably be substantially the same for all viewing angles that fall within the angular aperture of the focusing element along the one or more directions in which it is capable of focussing light (e.g. to within +/−10 microns, more preferably +/−5 microns). That is, each focussing element should be capable of directing light from any of the image elements in the image element array (which will lie in the same plane as one another), depending only on the viewing angle. This will automatically be the case for spherical lenses and preferred implementations of aspherical lenses.

In all of the above examples, it is preferred that the focusing element array 14, 140 is registered to the image element array 16, 160, most preferably in the alignment depicted (i.e. each focusing element 14, 140 is centred on the centre of the image element array unit cell 17, 170). However, this is not essential since an optically variable effect will still be achieved if there is no registration between the arrays, due to the matching periodicity and orientation. Nonetheless, registration between the arrays provides greater control over the resulting visual effect and particularly the ability to ensure it is the image carried by the centre area which is displayed to the on-axis viewing position. This is highly desirable since the stabilised "centre" image will be exhibited when the device is held in the default viewing position, i.e. on-axis, ensuring that a strong visual impact is conveyed. Moreover, requiring registration between the two arrays increases the security level of the device since this increases the difficulty of producing a counterfeit version.

FIG. 27 shows an image element array 16 according to a further embodiment of the invention which could be used to reduce the need for registration between the focusing element array and the image element array in order to achieve controlled results or alternatively could be used to provide additional visual effects as described below. It should be noted that FIG. 20 does not depict the individual image element positions 18, but rather the outline of centre area 19 and four outer areas A, B, C, D assigned to different respective images. Depending on how the image element array is implemented, the centre area 19 could be a single image element position (as in the FIG. 8 embodiment), or a sub-set of multiple image element positions (as in the FIG. 15 embodiment, in which case the individual image element positions are not shown). Similarly the outer areas A, B, C, D could each comprise a single image element position or could correspond to a group of identical image elements.

Unlike the previous embodiments, a further centre area 19' is now provided at one of the corners of the unit cell 17 (please note this further centre area 19' is not illustrated for all of the unit cells 17 depicted in FIG. 20). Like the first centre area 19, the further centre area 19' may comprise a single enlarged image element position assigned to the centre image 20 or a subset of multiple image element positions each carrying the same image element of the centre image 20.

The focusing element array 14 (of which one lens is represented in a first position by solid outline 14' and in a second position by dashed outline 14") may then be located in two positions relative to the image element array 16 and still presents the same centre image to the user when viewed on-axis and at small tilt angles. In this way, the registration requirements are reduced.

However, the image element array shown in FIG. 27 may also be used to provide an additional visual effect as will now be described with respect to FIG. 28. Here, the device 40 is divided into two regions 41 and 42. In the first region 41, the lens array 14 is aligned with the image element array 16 in such a way that the centre areas 19 are aligned with the centre of each lens, as denoted by the solid lens outline 14' in FIG. 27. In the second region 42 of the device, the lens array 14 is shifted with respect to the lens array in the first region of the device 41 such that now the centre of each lens is aligned with the further centre area 19', as denoted by dashed lens outline 14" in FIG. 27.

Since the image element positions within centre areas 19 and 19' all carry the same image, when the device is viewed on-axis, both regions 41 and 42 will present the same image to the user. In the example of FIG. 28, for simplicity, each image is a uniform region of one solid colour. Thus, both regions 41 and 42 exhibit the same colour and (assuming there is no visible line between the regions) cannot be distinguished from one another. When the device is tilted, however, the appearances of the two regions change differently from one another. This is because the order of the image element positions surrounding centre area 19 is reversed compared with that of those surrounding centre area 19'. Hence, when the device is viewed off-axis from the position of observer $O_a$, the first region of the device 41 will change to the colour carried by positions within sector A of the unit cell whilst the second region of the device 42 will change to a different colour carried by sector C. When the device is tilted in the opposite direction (observer $O_c$), the regions 41 and 42 will undergo the opposite changes so that the contrast between the two regions appears reversed relative to that seen by observer $O_a$. Similarly, observer $O_b$ will see the first region 41 appear in a colour determined by the colour of sector B, whereas region 42 will appear to have the colour of sector D. When the device is tilted in the opposite direction (observer $O_d$), again, the different colours will be reversed.

Of course, this is a simplified example and in other cases the images carried by each element position need not be solid colours but could be symbols, letters, three-dimensional objects etc., as before. It should also be appreciated that the boundary between the two regions 41, 42 of the device need not be a straight line as used for simplicity here, but rather the two regions (or more) of the device could together define some item of information, e.g. a first region of the device could take the shape of a letter or number and the second region of the device could act as a background. It should also be appreciated that an unregistered version of this device will produce a similar optical switch effect, although the position at which the two regions display the same image will not be controlled and therefore may not align with the on-axis viewing position.

Figure 29:
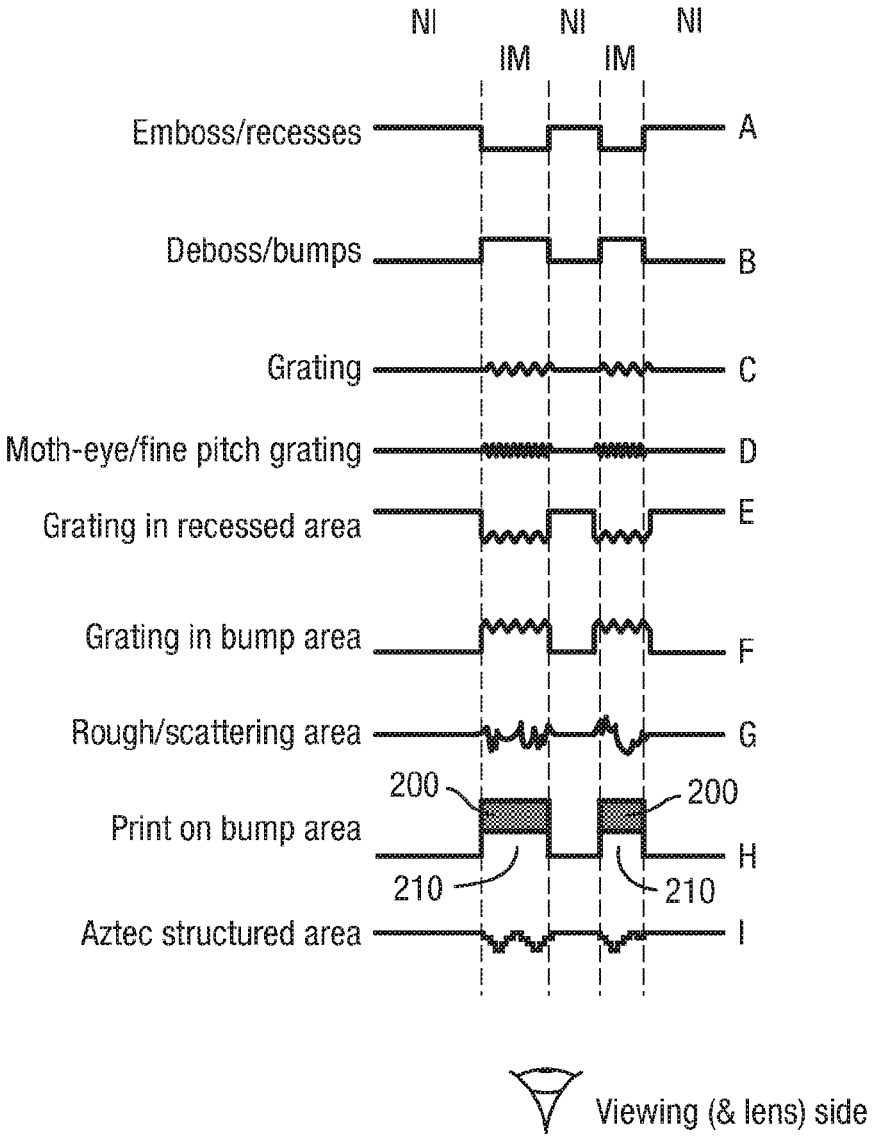

In all of the above examples, the image elements could be formed in various different ways. For example, the image elements could be formed of ink, for example printed onto the substrate 12 or onto an underlying layer which is then positioned adjacent to the substrate 12. However, in other examples the image elements can be formed by a relief structure and a variety of different relief structure suitable for this are shown in FIG. 29. Thus, FIG. 29*a* illustrates image regions of the image elements (IM), e.g. the shaded regions of image elements 180 shown in FIG. 17*c*, in the form of embossed or recessed regions while the non-embossed portions correspond to the non-imaged regions of the elements (NI). FIG. 29*b* illustrates image regions of the elements in the form of debossed lines or bumps.

In another approach, the relief structures can be in the form of diffraction gratings (FIG. 29*c*) or moth eye/fine pitch gratings (FIG. 29*d*). Where the image elements are formed by diffraction gratings, then different image portions of an image (within one image element or in different elements) can be formed by gratings with different characteristics. The difference may be in the pitch of the grating or rotation. This can be used to achieve a multi-colour diffractive image which will also exhibit a lenticular optical effect such as an animation through the mechanism described above. For example, if the image elements had been created by writing different diffraction tracks for each element, then as the device is tilted, lenticular transition from one image to another will occur as described above, during which the colour of the images will progressively change due to the different diffraction gratings. A preferred method for writing such a grating would be to use electron beam writing techniques or dot matrix techniques.

Such diffraction gratings for moth eye/fine pitch gratings can also be located on recesses or bumps such as those of FIGS. 29*a* and *b*, as shown in FIGS. 29*e* and *f* respectively.

FIG. 29*g* illustrates the use of a simple scattering structure providing an achromatic effect.

Further, in some cases the recesses of FIG. 29*a* could be provided with an ink or the debossed regions or bumps in FIG. 29*b* could be provided with an ink. The latter is shown in FIG. 29*h* where ink layers 200 are provided on bumps 210. Thus the image areas of each image element could be created by forming appropriate raised regions or bumps in a resin layer provided on a transparent substrate such as item 12 shown in FIG. 6. This could be achieved for example by cast curing or embossing. A coloured ink is then transferred onto the raised regions typically using a lithographic, flexographic or gravure process. In some examples, some image elements could be printed with one colour and other image elements could be printed with a second colour. In this manner when the device is tilted to create the lenticular animation effect described above, the images will also be seen to change colour as the observer moves from one view to another. In another example all of the image elements in one region of the device could be provided in one colour and then all in a different colour in another region of the device.

Finally, FIG. 29*i* illustrates the use of an Aztec structure.

Additionally, image and non-image areas could be defined by combination of different element types, e.g. the image areas could be formed from moth eye structures whilst the non-image areas could be formed from gratings. Alternatively, the image and non-image areas could even be formed by gratings of different pitch or orientation.

Where the image elements are formed solely of grating or moth-eye type structures, the relief depth will typically be in the range 0.05 microns to 0.5 microns. For structures such as those shown in FIGS. 29 *a, b, e, f, h* and *i*, the height or depth of the bumps/recesses is preferably in the range 0.5 to 10 μm and more preferably in the range of 1 to 2 μm. The typical width of the bumps or recesses will be defined by the nature of the artwork but will typically be less than 100 μm, more preferably less than 50 μm and even more preferably less than 25 μm. The size of the image elements and therefore the size of the bumps or recesses will be dependent on factors including the type of optical effect required, the size of the focusing elements and the desired device thickness. For example if the diameter of the focusing elements is 30 μm then each image element may be around 15 μm wide or less. Alternatively for a smooth animation effect it is preferable to have as many views as possible, typically at least five but ideally as many as thirty. In this case the size of the elements (and associated bumps or recesses) should be in the range 0.1 to 6 μm. In theory, there is no limit as to the number of image elements which can be included but in practice as the number increases, the resolution of the displayed images will decrease, since an ever decreasing proportion of the devices surface area is available for the display of each image.

In practice, however the image elements are formed, the width of the image elements is directly influenced by two factors, namely the pitch of the focusing element (e.g. lens) array and the number of image elements required within each lens pitch or lens base width. The former however is also indirectly determined by the thickness of the lenticular device. This is because the focal length for a plano-convex lens array (assuming the convex part of the lens is bounded by air and not a varnish) is approximated by the expression $r/(n-1)$, where r is the radius of curvature and n the refractive index of the lens resin. Since the latter has a value typically between 1.45 and 1.5 then we may say the lens focal approximates to 2r. Now for a close packed lens array, the base diameter of the lens is only slightly smaller than the lens pitch, and since the maximum value the base diameter can have is 2r, it then follows that the maximum value for the lens pitch is close to the value 2r which closely approximates to the lens focal length and therefore the device thickness.

To give an example, for a security thread component as may be incorporated into a banknote, the thickness of the lenticular structure and therefore the lens focal length is desirably less than 35 μm. Let us suppose we target a thickness and hence a focal length of 30 μm. The maximum base diameter we can have is from the previous discussion equal to 2r which closely approximates to the lens focal length of 30 μm. In this scenario the f-number, which equals (focal length/lens base diameter), is very close to 1. The lens pitch can be chosen to have a value only a few μm greater than the lens diameter—let us choose a value of 32 μm for the lens pitch. It therefore follows for a two channel one-dimensional lenticular device (i.e. two image element strips per unit cell) we need to fit two image strips into 32 μm and therefore each strip is 16 μm wide. Such a strip or line width is already well below the resolution of conventional web-based printing techniques such as flexo-graphic, lithographic (wet, waterless & UV) or gravure, which even within the security printing industry have proven print resolutions down to the 50 to 35 μm level at best. Similarly for a four channel one-dimensional lenticular the problem of print resolution becomes more severe as the printed line width requirement drops down to 8 μm (in this example), and so on.

As a result, for ink based printing of the image elements, the f-number of the lens should preferably be minimised, in order to maximise the lens base diameter for a given structure thickness. For example suppose we choose a higher f-number of 3, consequently the lens base diameter will be 30/3 or 10 μm. Such a lens will be at the boundary of diffractive and refractive physics—however, even if we still consider it to be primarily a diffractive device then the we may assume a lens pitch of say 12 μm. Consider once again the case of a two channel device, now we will need to print an image strip of only 6 μm and for a four channel device a strip width of only 3 μm. Conventional printing techniques will generally not be adequate to achieve such high resolution. However, suitable methods for forming the image elements include those described in WO-A-2008/000350, WO-A-2011/102800 and EP-A-2460667.

This is also where using a diffractive structure to provide the image elements provides a major resolution advantage: although ink-based printing is generally preferred for reflective contrast and light source invariance, techniques such as modern e-beam lithography can be used generate to originate diffractive image strips down to widths of 1 μm or less and such ultra-high resolution structures can be efficiently replicated using UV cast cure techniques.

As mentioned above, the thickness of the device 10 is directly related to the size of the focusing elements and so the optical geometry must be taken into account when selecting the thickness of the transparent layer 12. In preferred examples the device thickness is in the range 5 to 200 microns. "Thick" devices at the upper end of this range are suitable for incorporation into documents such as identification cards and drivers licences, as well as into labels and similar. For documents such as banknotes, thinner devices are desired as mentioned above. At the lower end of the range, the limit is set by diffraction effects that arise as the focusing element diameter reduces: e.g. lenses of less than 10 micron base diameter (hence focal length approximately 10 microns) and more especially less than 5 microns (focal length approximately 5 microns) will tend to suffer from such effects. Therefore the limiting thickness of such structures is believed to lie between about 5 and 10 microns.

In the case of release structures forming the image elements, these will preferably be embossed or cast cured into a suitable resin layer on the opposite side of the substrate 12 to the lens array 14. The lens array 14 itself can also be made using cast cure or embossing processes, or could be printed using suitable transparent substances. The periodicity and therefore maximum base diameter of the lenticular focusing elements is preferably in the range 5 to 200 μm, more preferably 10 to 60 μm and even more preferably 20 to 40 μm. The f number for the lenticular focusing elements is preferably in the range 0.1 to 16 and more preferably 0.5 to 4.

Whilst in the above embodiments, the focusing elements have taken the form of lenses, in all cases these could be substituted by an array of focusing mirror elements. Suitable mirrors could be formed for example by applying a reflective layer such as a suitable metal to the cast-cured or embossed lens relief structure. In embodiments making use of mirrors, the image element array should be semi-transparent, e.g. having a sufficiently low fill factor to allow light to reach the mirrors and then reflect back through the gaps between the image elements. For example, the fill factor would need to be less than $1/\sqrt{2}$ in order that that at least 50% of the incident light is reflected back to the observer on two passes through the image element array.

Security devices of the sort described above can be incorporated into or applied to any article for which an authenticity check is desirable. In particular, such devices may be applied to or incorporated into documents of value such as banknotes, passports, driving licences, cheques, identification cards etc.

The security device or article can be arranged either wholly on the surface of the base substrate of the security document, as in the case of a stripe or patch, or can be visible only partly on the surface of the document substrate, e.g. in the form of a windowed security thread. Security threads are now present in many of the world's currencies as well as vouchers, passports, travellers' cheques and other documents. In many cases the thread is provided in a partially embedded or windowed fashion where the thread appears to weave in and out of the paper and is visible in windows in one or both surfaces of the base substrate. One method for producing paper with so-called windowed threads can be found in EP-A-0059056. EP-A-0860298 and WO-A-03095188 describe different approaches for the embedding of wider partially exposed threads into a paper substrate. Wide threads, typically having a width of 2 to 6 mm, are particularly useful as the additional exposed thread surface area allows for better use of optically variable devices, such as that presently disclosed.

The security device or article may be subsequently incorporated into a paper or polymer base substrate so that it is viewable from both sides of the finished security substrate. Methods of incorporating security elements in such a manner are described in EP-A-1141480 and WO-A-03054297. In the method described in EP-A-1141480, one side of the security element is wholly exposed at one surface of the substrate in which it is partially embedded, and partially exposed in windows at the other surface of the substrate.

Base substrates suitable for making security substrates for security documents may be formed from any conventional materials, including paper and polymer. Techniques are known in the art for forming substantially transparent regions in each of these types of substrate. For example, WO-A-8300659 describes a polymer banknote formed from a transparent substrate comprising an opacifying coating on both sides of the substrate. The opacifying coating is omitted in localised regions on both sides of the substrate to form a transparent region. In this case the transparent substrate can be an integral part of the security device or a separate security device can be applied to the transparent substrate of the document. WO-A-0039391 describes a method of making a transparent region in a paper substrate. Other methods for forming transparent regions in paper substrates are described in EP-A-723501, EP-A-724519, WO-A-03054297 and EP-A-1398174.

The security device may also be applied to one side of a paper substrate so that portions are located in an aperture formed in the paper substrate. An example of a method of producing such an aperture can be found in WO-A-03054297. An alternative method of incorporating a security element which is visible in apertures in one side of a paper substrate and wholly exposed on the other side of the paper substrate can be found in WO-A-2000/39391.

Examples of such documents of value and techniques for incorporating a security device will now be described with reference to FIGS. 30 to 33.

FIG. 30 depicts an exemplary document of value 50, here in the form of a banknote. FIG. 30*a* shows the banknote in plan view whilst FIG. 30*b* shows the same banknote in cross-section along the line X-X'. In this case, the banknote is a polymer (or hybrid polymer/paper) banknote, having a transparent substrate 51. Two opacifying layers 52*a* and 52*b* are applied to either side of the transparent substrate 51, which may take the form of opacifying coatings such as white ink, or could be paper layers laminated to the substrate 51.

The opacifying layers 52*a* and 52*b* are emitted across a region 55 which forms a window within which the security device is located. As shown best in the cross-section of FIG. 30*b*, an array of focusing elements 56 is provided on one side of the transparent substrate 51, and a corresponding image element array 57 is provided on the opposite surface of the substrate. The focusing element array 56 and image element array 57 are each as described above with respect to any of the disclosed embodiments. When the document is viewed from the side of lens array 56, the aforementioned lenticular effect can be viewed upon tilting the device. It should be noted that in modifications of this embodiment the window 55 could be a half window with the opacifying layer 52*b* continuing across all or part of the window over the image element array 57. In this case, the window will not be transparent but may (or may not) still appear relatively translucent compared to its surroundings. The banknote may also comprise a series of windows or half-windows in which regions of the security device are visible.

In FIG. 31 the banknote 50 is a conventional paper-based banknote provided with a security article 60 in the form of a security thread, which is inserted during paper-making such that it is partially embedded into the paper so that portions of the paper 53 and 54 lie on either side of the thread. This can be done using the techniques described in EP0059056 where paper is not formed in the window regions during the paper making process thus exposing the security thread in window regions 65 of the banknote. Alternatively the window regions 65 may for example be formed by abrading the surface of the paper in these regions after insertion of the thread. The security device is formed on the thread 60, which comprises a transparent substrate 63 with lens array 61 provided on one side and image element array 62 provided on the other. In the illustration, the lens array 61 is depicted as being discontinuous between each exposed region of the thread, although in practice typically this will not be the case and the security device will be formed continuously along the thread. Alternatively several security devices could be spaced from each other along the thread, with different or identical images displayed by each. In one example, a first window could contain a first region of the device shown in the FIG. 27 embodiment, and a second region could contain a second region shown in the FIG. 27 embodiment so that the two windows display opposite effects upon tilting.

In FIG. 32, the banknote 50 is again a conventional paper-based banknote, provided with a strip element or insert 60. The strip 60 is based on a transparent substrate 63 and is inserted between two plies of paper 53 and 54. The security device is formed by a lens array 61 on one side of the strip substrate 63, and an image element array 62 on the other. The paper plies 53 and 54 are apertured across region 65 to reveal the security device, which in this case may be present across the whole of the strip 60 or could be localised within the aperture region 65.

A further embodiment is shown in FIG. 33 where FIGS. 33(*a*) and (*b*) show the front and rear sides of the document respectively, and FIG. 33(*c*) is a cross section along line Z-Z'. Security article 60 is a strip or band comprising a security device according to any of the embodiments described above. The security article 60 is formed into a security document 50 comprising a fibrous substrate 53, using a method described in EP-A-1141480. The strip is incorporated into the security document such that it is fully exposed on one side of the document (FIG. 33(*a*)) and exposed in one or more windows 65 on the opposite side of the document (FIG. 33(*b*)). Again, the security device is formed on the strip 60, which comprises a transparent substrate 63 with a lens array 61 formed on one surface and image element array 62 formed on the other.

Alternatively a similar construction can be achieved by providing paper 53 with an aperture 65 and adhering the strip element 60 on to one side of the paper 53 across the aperture 65. The aperture may be formed during papermaking or after papermaking for example by die-cutting or laser cutting.

In general when applying a security article such as a strip or patch carrying the security device to a document, it is preferable to have the side of the device carrying the image element array bonded to the document substrate and not the lens side, since contact between lenses and an adhesive can render the lenses inoperative. However, the adhesive could be applied to the lens array as a pattern that the leaves an intended windowed zone of the lens array uncoated, with the strip or patch then being applied in register (in the machine direction of the substrate) so the uncoated lens region registers with the substrate hole or window It is also worth noting that since the device only exhibits the optical effect when viewed from one side, it is not especially advantageous to apply over a window region and indeed it could be applied over a non-windowed substrate. Similarly, in the context of a polymer substrate, the device is well-suited to arranging in half-window locations.

The security device of the current invention can be made machine readable by the introduction of detectable materials in any of the layers or by the introduction of separate machine-readable layers. Detectable materials that react to an external stimulus include but are not limited to fluorescent, phosphorescent, infrared absorbing, thermochromic, photochromic, magnetic, electrochromic, conductive and piezochromic materials.

Additional optically variable devices or materials can be included in the security device such as thin film interference elements, liquid crystal material and photonic crystal materials. Such materials may be in the form of filmic layers or as pigmented materials suitable for application by printing. If these materials are transparent they may be included in the same region of the device as the security feature of the current invention or alternatively and if they are opaque may be positioned in a separate laterally spaced region of the device.

The security device may comprise a metallic layer laterally spaced from the security feature of the current invention. The presence of a metallic layer can be used to conceal the presence of a machine readable dark magnetic layer. When a magnetic material is incorporated into the device the magnetic material can be applied in any design but common examples include the use of magnetic tramlines or the use of magnetic blocks to form a coded structure. Suitable magnetic materials include iron oxide pigments ($Fe_2O_3$ or $Fe_3O_4$), barium or strontium ferrites, iron, nickel, cobalt and alloys of these. In this context the term "alloy" includes materials such as Nickel:Cobalt, Iron:Aluminium:Nickel: Cobalt and the like. Flake Nickel materials can be used; in addition Iron flake materials are suitable. Typical nickel flakes have lateral dimensions in the range 5-50 microns and a thickness less than 2 microns. Typical iron flakes have lateral dimensions in the range 10-30 microns and a thickness less than 2 microns.

In an alternative machine-readable embodiment a transparent magnetic layer can be incorporated at any position within the device structure. Suitable transparent magnetic layers containing a distribution of particles of a magnetic material of a size and distributed in a concentration at which the magnetic layer remains transparent are described in WO03091953 and WO03091952.

Negative or positive indicia may be created in the metallic layer or any suitable opaque layer. One way to produce partially metallised/demetallised films in which no metal is present in controlled and clearly defined areas, is to selectively demetallise regions using a resist and etch technique such as is described in U.S. Pat. No. 4,652,015. Other techniques for achieving similar effects are for example aluminium can be vacuum deposited through a mask, or aluminium can be selectively removed from a composite strip of a plastic carrier and aluminium using an excimer laser. The metallic regions may be alternatively provided by printing a metal effect ink having a metallic appearance such as Metalstar® inks sold by Eckart.

The invention claimed is:

1. A security device, comprising:

an array of focusing elements, each focusing element being adapted to focus light in at least a first direction, the focusing elements being arranged on a regular grid in at least one dimension; and an array of image elements overlapping the array of focusing elements, the image elements being arranged based on a repeating unit cell defining image element positions, the periodicity of the unit cells being substantially the same as that of the grid on which the array of focusing elements is arranged, the unit cell defining a set of image element positions therewithin, each image element position within the unit cell being assigned to carry an image element of a respective corresponding image;

whereby, depending on the viewing angle, the array of focusing elements directs light from selected image element positions to the viewer, such that as the device is tilted different ones of the respective images are displayed by the image elements at the selected image element positions in combination, sequentially;

wherein a center area of each unit cell, comprising one or more image element positions, is provided with one or more image elements of a corresponding center image, the center area being larger than each outer area of the unit cell, the outer areas being located outside the center area and provided with image elements of other respective images defined by the array of image elements, such that a first range of viewing angles, over which the center image is displayed to a viewer, is greater than a range of viewing angles over which each other image is displayed, and wherein an appearance of the security device remains static over the first range of viewing angles.

2. A security device according to claim 1, wherein the center area comprises a single center image element position which is larger than each of the other image element positions defined by the unit cell.

3. A security device according to claim 2, wherein the center image element position is at least 10% larger than of the average size of the other image element positions defined by the unit cell.

4. A security device according to claim 2, wherein the image element positions outside and immediately adjacent the center image element position are smaller than surrounding image element positions located towards the periphery of the unit cell.

5. A security device according to claim 2, wherein all of the image elements except the center image element in the unit cell are of substantially the same size.

6. A security device according to claim 2, wherein each outer area of the unit cell comprises a single image element position which is smaller than the center image element position.

7. A security device according to claim 1, wherein the unit cell defines a two-dimensional set of image element positions, comprising image element positions arranged along both the first direction and a second orthogonal direction.

8. A security device according to claim 1, wherein the center area comprises a sub-set of at least two of the image element positions defined by the unit cell, each image element position in the sub-set being provided with a copy of the same image element of the center image.

9. A security device according to claim 8, wherein the unit cell defines a two-dimensional set of image element positions, comprising image element positions arranged along both the first direction and a second orthogonal direction, and the sub-set comprises a two-dimensional array of image element positions.

10. A security device according to claim 9, wherein the sub-set comprises at least two adjacent image element positions arranged along the first direction and at least two adjacent image element positions arranged along the second direction.

11. A security device according to claim 1, wherein the center area is centered on the center of the unit cell.

12. A security device according to claim 1, wherein the center area is at least 10% larger than the average size of the outer areas of the unit cell.

13. A security device according to claim 1, wherein the array of focusing elements and the array of image elements are registered to one another.

14. A security device according to claim 13, wherein the array of focusing elements and the array of image elements is configured such that the center image is displayed when the security device is viewed at all angles between the normal and a threshold angle, along at least the first direction, the threshold angle being between 2 and 10 degrees from the normal.

15. A security device according to claim 1, wherein the unit cell comprises at least two outer areas on each side of the center area along the first direction.

16. A security device according to claim 1, wherein the focal length of each focusing element is substantially the same for all viewing angles along the first and/or second directions in which it is capable of focusing light.

17. A security device according to claim 1, wherein the focusing elements focus light in the first direction only.

18. A security device according to claim 1, wherein the focusing elements are each adapted to focus light in at least the first direction and a second direction which is orthogonal, and the focusing elements are arranged on a regular two-dimensional grid.

19. A security device according to claim 18, wherein the grid on which the focusing elements are arranged is an orthogonal grid and the unit cell is square or rectangular; or the grid on which the focusing elements are arranged is a hexagonal grid and the unit cell is a hexagon.

20. A security device according to claim 18, wherein the focusing elements are spherical or aspherical focusing elements.

21. A security device according to claim 18, wherein each focusing element has substantially equal focal power in each of the at least two orthogonal directions.

22. A security device according to claim 18, wherein the unit cell comprises outer areas provided with respective images which are different from the center image outside the center area along at least the first direction and the second direction.

23. A security device according to claim 22, wherein at least two outer areas are provided on each side of the center area along the first and second directions.

24. A security device according to claim 1, wherein the array of image elements is located approximately in the focal plane of the focusing elements.

25. A security device according to claim 1, wherein the security device is formed as a security thread, strip, foil, insert, label or patch.

26. An article provided with a security device according to claim 1.

27. An article according to claim 26, wherein the article is selected from banknotes, cheques, passports, identity cards, certificates of authenticity, fiscal stamps and other documents for securing value or personal identity.

28. A method of manufacturing a security device, the method comprising:

providing an array of focusing elements, each focusing element being adapted to focus light in at least a first direction, the focusing elements being arranged on a regular grid in at least one dimension; and forming an array of image elements overlapping the array of focusing elements, the image elements being arranged based on a repeating unit cell defining image element positions, the periodicity of the unit cells being substantially the same as that of the grid on which the array of focusing elements is arranged, the unit cell defining a set of image element positions therewithin, each image element position within the unit cell being assigned to carry an image element of a respective corresponding image;

whereby, depending on the viewing angle, the array of focusing elements directs light from selected image element positions to the viewer, such that as the device is tilted different ones of the respective images are displayed by the image elements at the selected image element positions in combination, sequentially;

wherein a center area of each unit cell, comprising one or more image element positions, is provided with one or more carry image elements of a corresponding center image, the center area being larger than each outer area of the unit cell, the outer areas being located outside the center area and provided with image elements of other respective images defined by the array of image elements, such that a first range of viewing angles over which the center image is displayed to a viewer is greater than a range of viewing angles over which each other image is displayed, and wherein an appearance of the security device remains static over the first range of viewing angles.

29. A method according to claim 28, wherein the array of focusing elements and the array of image elements are overlapped in registration to one another.

* * * * *